US007837314B2

(12) United States Patent
Kyoso

(10) Patent No.: US 7,837,314 B2
(45) Date of Patent: Nov. 23, 2010

(54) LIQUID EJECTION APPARATUS AND IMAGE FORMING APPARATUS

(75) Inventor: Tadashi Kyoso, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 1085 days.

(21) Appl. No.: 11/542,207

(22) Filed: Oct. 4, 2006

(65) Prior Publication Data

US 2008/0291254 A1 Nov. 27, 2008

(30) Foreign Application Priority Data

Oct. 5, 2005 (JP) ..... 2005-292654

(51) Int. Cl.

| | |
|---|---|
| ***B41J 2/19*** | (2006.01) |
| ***B41J 2/195*** | (2006.01) |
| ***B41J 29/38*** | (2006.01) |
| ***B41J 2/17*** | (2006.01) |
| ***B41J 2/175*** | (2006.01) |
| ***B41J 2/18*** | (2006.01) |

(52) U.S. Cl. ..... 347/92; 347/85; 347/93

(58) Field of Classification Search ..... 347/92, 347/85, 93, 6, 7, 84, 86, 87, 89, 95

See application file for complete search history.

(56) References Cited

U.S. PATENT DOCUMENTS

| | | | | |
|---|---|---|---|---|
| 5,221,936 | A * | 6/1993 | Saito et al. | 347/86 |
| 5,455,615 | A | 10/1995 | Burr et al. | |
| 5,677,718 | A | 10/1997 | Crawford et al. | |
| 5,808,643 | A * | 9/1998 | Tracy et al. | 347/92 |
| 5,847,734 | A * | 12/1998 | Pawlowski, Jr. | 347/86 |
| 6,095,633 | A * | 8/2000 | Harshbarger et al. | 347/30 |
| 6,174,050 | B1 * | 1/2001 | Kashino et al. | 347/65 |
| 6,244,694 | B1 * | 6/2001 | Weber et al. | 347/65 |
| 6,260,962 | B1 * | 7/2001 | Yano et al. | 347/94 |
| 6,267,251 | B1 * | 7/2001 | Sullivan | 210/488 |
| 6,270,205 | B1 * | 8/2001 | Takata | 347/85 |
| 6,457,813 | B2 * | 10/2002 | Silverbrook | 347/54 |
| 6,517,178 | B1 * | 2/2003 | Yamamoto et al. | 347/15 |
| 6,880,926 | B2 * | 4/2005 | Childs et al. | 347/89 |
| 7,273,267 | B2 * | 9/2007 | Yokouchi et al. | 347/70 |
| 7,614,727 | B2 * | 11/2009 | Hori | 347/71 |
| 2002/0024573 | A1 * | 2/2002 | Hoen et al. | 347/92 |
| 2006/0001715 | A1 * | 1/2006 | Umeda et al. | 347/86 |

FOREIGN PATENT DOCUMENTS

| | | | |
|---|---|---|---|
| JP | 55158975 | A * | 12/1980 |
| JP | 02122939 | A * | 5/1990 |
| JP | 04363254 | A * | 12/1992 |
| JP | 6-115087 | A | 4/1994 |

* cited by examiner

*Primary Examiner*—Stephen D Meier
*Assistant Examiner*—Leonard S Liang
(74) *Attorney, Agent, or Firm*—Birch, Stewart, Kolasch & Birch, LLP

(57) ABSTRACT

The liquid ejection apparatus comprises: a plurality of ejection ports which eject liquid; a plurality of pressure chambers which are connected respectively to the ejection ports; pressure generating elements which are provided to correspond respectively to the pressure chambers and create a pressure change in the liquid in the respective pressure chambers; a common flow channel which is connected to the pressure chambers and supplies the liquid to the pressure chambers; a movable member which is disposed inside the common flow channel and can move while making contact with a flow channel wall forming one portion of an internal circumferential surface of the common flow channel; and a movement device which moves the movable member inside the common flow channel.

17 Claims, 26 Drawing Sheets

LIQUID EJECTION APPARATUS AND IMAGE FORMING APPARATUS

BACKGROUND OF THE INVENTION

1. Field of the Invention

The present invention relates to a liquid ejection apparatus and an image forming apparatus using a liquid ejection apparatus, and more particularly, to air bubble removal technology suitable for removing an air bubble, which is a cause of an ejection defect, from a flow channel in such a liquid ejection apparatus as an inkjet head including a plurality of liquid droplet ejection ports (nozzles).

2. Description of the Related Art

In an inkjet type of recording apparatus, if an air bubble enters inside an ink flow channel, then an ejection defect occurs in that ink ceases to be ejected, or the ink ejection volume (the size of the dot formed by a droplet ejected onto a recording medium) or the droplet ejection position (direction of flight) becomes improper. In response to problems of this kind, in order to improve air bubble removal characteristics inside the ink flow channels, for example, Japanese Patent Application Publication No. 6-115087 discloses a structure in which the ends of the flow channels are formed to fine dimensions.

According to Japanese Patent Application Publication No. 6-115087, the cross-sectional area of an ink supply manifold which supplies ink to each of a plurality of ink supply channels is gradually reduced, the ink flow speed inside the manifold is maintained at or above a prescribed value, and thus the retention of air bubbles on the interior walls of the manifold is suppressed.

It is known that the removal characteristics of air bubbles are greatly dependent on the flow speed (m/s) in the flow channel. Here, the flow speed (m/s) is expressed as follows: "flow speed (m/s)=volume velocity ($m^3$/s)/cross-sectional area of flow channel ($m^2$)". In other words, the reference to "raising the air bubble removal characteristics" described in Japanese Patent Application Publication No. 6-115087 means to increase the flow speed (m/s) by reducing the cross-sectional area of flow channel.

However, in recent inkjet recording apparatuses, due to demands for increased head length and compatibility with high-viscosity inks, and the like, situations have occurred where the cross-sectional area of the flow channel is inevitably required to increase, and this makes it difficult to remove the air bubbles on the basis of the flow speed.

Considering a case where a high-viscosity ink is used, since the flow channel resistance is directly proportional to the ink viscosity, then if the cross-sectional area of the flow channel is not increased sufficiently, it is not possible to keep the pressure loss inside the head (=flow channel resistance× volumetric speed) to within a specified value (for example, 800 Pa). If the pressure loss rises and exceeds the specified value, then it is difficult that the ink supply to the pressure chambers keeps up with demand, and eventually it becomes impossible to perform ejection.

Furthermore, considering a case where a long head is used, since the flow channel resistance is directly proportional to the length of the flow channel, then if the cross-sectional area of the flow channel is not increased sufficiently, it is not possible to keep the pressure loss inside the head (=flow channel resistance×volumetric speed) to within a specified value (for example, 800 Pa).

For these reasons, according to recent inkjet recording apparatuses, it has become difficult to sufficiently remove the air bubbles on the basis of the flow speed.

SUMMARY OF THE INVENTION

The present invention is contrived in view of these circumstances, an object thereof being to provide a liquid ejection apparatus and an image forming apparatus using a liquid ejection apparatus whereby an air bubble inside the flow channel can be removed efficiently.

In order to attain the aforementioned object, the present invention is directed to a liquid ejection apparatus comprising: a plurality of ejection ports which eject liquid; a plurality of pressure chambers which are connected respectively to the ejection ports; pressure generating elements which are provided to correspond respectively to the pressure chambers and create a pressure change in the liquid in the respective pressure chambers; a common flow channel which is connected to the pressure chambers and supplies the liquid to the pressure chambers; a movable member which is disposed inside the common flow channel and can move while making contact with a flow channel wall forming one portion of an internal circumferential surface of the common flow channel; and a movement device which moves the movable member inside the common flow channel.

According to this aspect of the present invention, by making the movable member contact the flow channel wall and moving the movable member by means of the movement device, it is possible to strip off an air bubble adhering to the flow channel wall by means of the movable member. Accordingly, the movement of the air bubble is promoted, and thus air bubble removal characteristics can be improved. The movement device may be driven on the basis of automatic control, or it may be manually controlled.

Each "pressure generating element" in the present invention may be a piezoelectric element or other actuators that can change the volume of the pressure chamber, or may be a heater (heating element) which heats and evaporates the liquid in the pressure chamber.

Preferably, at least a portion of the movable member is constituted by a ferromagnetic body; and the movement device includes a magnetic field generation device which generates a magnetic field.

According to this aspect of the present invention, it is possible to control the position and movement of the movable member, by a non-contact method, by means of the action of a magnetic field generated by the magnetic field generation device, and it is possible to move the movable member on the basis of a simple composition. The magnetic field generation device may be a permanent magnet, an electromagnet, or a combination of these.

Preferably, the movable member includes: an inclined plane section which has an acute angle so as to enter in between the flow channel wall and an air bubble adhering to the flow channel wall and strip the air bubble from the flow channel wall; and a hollow section which retains the air bubble stripped from the flow channel wall.

According to this aspect of the present invention, the acute-angled inclined plane section is inserted in between the flow channel wall and the air bubble, and therefore the air bubble can be stripped more readily from the flow channel wall. Furthermore, the air bubbles stripped from the flow channel wall can be collected into the hollow section of the movable member and moved together with the movable member. By moving the movable member while collecting up the air bubbles in this way, the air bubble removal properties are further improved.

Preferably, the flow channel wall along which the movable member slides has an inclined plane structure wherein height of the flow channel wall gradually increases in a direction of movement of the movable member.

The air bubbles progressively rise upwards inside the flow channel. Therefore, according to this aspect of the present invention, the inclined plane structure is adopted for the flow channel wall, and hence it is possible to lead (collect) the air bubble to the highest position in conjunction with the movement of the movable member. By forming an expulsion port (circulating hole, or the like) for expelling an air bubble at the end toward which the movable member moves (at the highest position in the inclined plane structure, for example), it is possible to expel the collected air bubble to the exterior, with good efficiency.

Preferably, the liquid ejection apparatus further comprises a holding section which is provided in the common flow channel and supports a lower face of the movable member.

According to this aspect of the present invention, a shape (holding section) which is able to hold the movable member in a portion of the common flow channel is formed, and thereby, it is possible to hold the movable member in a stable fashion.

Preferably, the holding section supports the lower face of the movable member in such a manner that the movable member is separated from the flow channel wall.

According to this aspect of the present invention, it is possible to select in a simple fashion between a state where the movable member is in contact with the flow channel wall and a state where it is not in contact with same.

For example, there is a mode in which a first magnetic field generation device forming a movement device for moving the movable member while causing same to make contact with the flow channel wall, and a second magnetic field generation device for moving the movable member while causing same to make contact with the holding section, are provided.

Preferably, the flow channel wall forms a ceiling face of the common flow channel; the flow channel wall has a non-linear shape in which height of the flow channel wall varies when viewed in a direction of movement of the movable member; and the movable member has a non-linear shape when viewed in the direction of movement of the movable member, in such a manner that the non-linear shape of the movable member matches the non-linear shape of the flow channel wall.

The term "non-linear shape" here includes a curved shape, a bent line shape, and a combination of these. According to this aspect of the present invention, since air bubbles are liable to collect in the vicinity of the apex of the non-linear shape (in a case where the shape has a plurality of apices, in the vicinity of each of the apices), then it is possible to expel the collected air bubbles readily.

Preferably, the liquid ejection apparatus further comprises a flow channel which is provided in an end section of the common flow channel in terms of a direction of movement of the movable member and via which an air bubble is expelled to an exterior of the common flow channel.

According to this aspect of the present invention, it is possible to readily expel the air bubble collected by the movable member, from the flow channel for expelling an air bubble, to the exterior of the common flow channel.

Preferably, the movable member has a recess shape which is hollowed in a reverse direction with respect to a direction of movement of the movable member by the movement device.

By forming the shape of the movable member to a recess shape (for example, a V shape which opens in the direction of travel) which is hollowed in the reverse direction to the direction of movement (direction of travel), rather than in a perpendicular shape with respect to the direction of movement, then the air bubble can be collected in the base portion of the recess shape (the rearward portion in terms of the direction of travel), and hence the movable member can be moved while the movable member retains the collected air bubble.

Preferably, the movable member includes: a projecting end section which projects in a direction of movement of the movable member by the movement device; and an end portion which is located posteriorly to the projecting end section in terms of the direction of movement of the movable member by the movement device; and an air bubble removal groove into which an air bubble stripped from the flow channel wall by the movable member is introduced, is provided in an end part of the common liquid chamber which overlaps with the end portion of the movable member.

Since the shape of the movable member is formed in a projecting shape (for example, a V shape having the apex orientated toward the direction of travel) which projects in a forward direction with respect to the direction of movement (direction of travel), rather than in a perpendicular shape with respect to the direction of movement, an air bubble stripped from the flow channel wall by the movable member is moved toward the end portion of the movable member which is situated to the rear side of (namely, in a position behind) the projecting end section of the projecting shape of the movable member. The air bubble moved to the vicinity of the end portion of the movable member in this way is introduced into the air bubble removal groove. In this way, the air bubble can be expelled with good efficiency.

Preferably, a portion of the movable member which makes contact with the flow channel wall is constituted by an elastic member.

According to this aspect of the present invention, the elastic member can make contact with the flow channel wall while deforming, and hence it is able to apply a force to the flow channel wall without causing damage to the wall.

Preferably, the flow channel wall includes a recess section which forms a projection-shaped space in which a gap is formed between the flow channel wall and the elastic member that is released from a deformed state assumed while the movable member is in contact with the flow channel wall and returns to an original shape of the elastic member.

According to this aspect of the present invention, the surface of the flow channel wall has a projection-recess shape (undulating shape), and the relative distance between the elastic member and the wall surface changes according to the shape (projection section or recess section) of the wall surface. At the recess section in the flow channel wall, the distance from the elastic member to the wall surface increases. In other words, the recess section in the flow channel wall creates a projection-shaped space which projects toward the side opposite to the flow channel (projecting toward the outside of the common flow channel). This projection-shaped space functions as an "escape" space where contact between the wall face and the elastic member is avoided. Consequently, when the elastic member arrives at a position opposing the recess section (escape groove), the elastic member ceases to make contact with the wall surface and it is released from the deformed state that it assumes during the contact. Therefore, the direction of movement of the movable member can be readily reversed without applying excessive force to the elastic member.

Preferably, the liquid ejection apparatus further comprises a guide section which is provided in the common flow channel and restricts a position of the movable member during movement of the movable member, wherein the guide section has a shape which forms a travel path for guiding the movable member to a position where a gap is formed between the flow channel wall and the elastic member that is released from a deformed state assumed while the movable member is in contact with the flow channel wall and returns to an original shape of the elastic member.

According to this aspect of the present invention, a structure is adopted in which the movable member is moved along a path of travel created by the guide section, and a path of travel is formed which causes the movable member to move to a position where it is separated from the flow channel wall.

By separating the movable member from the flow channel wall by guiding same by means of the guide section, the movable member is released from a deformed state which is assumed by the movable member during the contact with flow channel wall, and reverts to its original shape. Therefore, the direction of movement of the movable member can be readily reversed without applying excessive force to the elastic member.

Furthermore, as described above, a structure which allows the relative position (distance) between the movable member and the flow channel wall to be changed by using the guide section does not require the provision of an escape structure in the flow channel wall (undulation of the wall surface) as described above, and a flat flow channel wall which has no positions where air bubbles are liable to stagnate can be formed.

Preferably, the movable member has a columnar shape and relatively lower lyophilic properties than the flow channel wall, and is moved while rolling over the flow channel wall by the movement device.

According to this aspect of the present invention, the air bubble adhering to the flow channel wall readily transfer to the movable member, which has lower lyophilic properties than the flow channel wall, and become attached to the surface of the movable member. Therefore, it is possible to collect and move the air bubble adhering to the flow channel wall by making it become attached to the movable member. Moreover, since the columnar shaped (round cylindrical) movable member simply rolls over the wall surface, it does not cause any damage to the flow channel wall.

Preferably, the movable member includes a permanent magnet.

According to this aspect of the present invention, it is possible to readily switch between a state where the movable member is made to contact the wall surface and a state where it does not contact same, according to the orientation of an external magnetic field. Furthermore, it is also possible to move the movable member by using the repulsing force created by an external magnetic field.

Preferably, the liquid ejection apparatus further comprises a diaphragm which forms a portion of surfaces of the pressure chambers, wherein the pressure generating elements are formed by piezoelectric elements which are provided on an opposite surface of the diaphragm from the pressure chambers; and the common flow channel is provided on an opposite side of the diaphragm from the pressure chambers.

According to this aspect of the present invention, the common flow channel is formed on the opposite side of the diaphragm to the pressure chambers, and the liquid is supplied to the respective pressure chambers from this common flow channel. By adopting a flow channel structure of this kind, it becomes possible to arrange the pressure generating elements at high density (and hence to achieve a high-density arrangement of the nozzles). Furthermore, it is possible to reduce the flow channel resistance of the liquid supply channels from the common flow channel to the pressure chambers, and a sufficient liquid supply volume can be ensured, even in the case of a high-viscosity liquid.

In order to attain the aforementioned object, the present invention is also directed to an image forming apparatus comprising one of the liquid ejection apparatuses described above, the image forming apparatus forming an image on a recording medium by means of the liquid ejected from the ejection ports.

The inkjet recording apparatus forming one example of the image forming apparatus described above comprises: a liquid ejection head (recording head) having a high-density arrangement of a plurality of liquid droplet ejection elements (ink chamber units), each comprising an ejection port (nozzle) for ejecting an ink droplet in order to form a dot and a pressure generating device (piezoelectric actuator) which generates an ejection pressure; and an ejection control device which controls the ejection of liquid droplets from the liquid ejection head on the basis of the ink ejection data (dot image data) generated from an input image. An image is formed on a recording medium by means of the liquid droplets ejected from the nozzles.

For example, color conversion or half-toning is carried out on the basis of image data (print data) input via an image input device, thereby generating ink ejection data corresponding to the ink colors. The pressure generating elements corresponding to the respective nozzles of the liquid ejection head are driven and controlled on the basis of this ink ejection data, in such a manner that ink droplets are ejected from the nozzles.

In order to achieve a high-resolution image output, a desirable mode is one using a liquid ejection head (print head) in which a plurality of liquid droplet ejection elements (ink chamber units) are arranged at high density, each liquid droplet ejection element being constituted by a nozzle (ejection port) which ejects ink liquid, and a pressure chamber and pressure generating element corresponding to the nozzle.

A compositional embodiment of a liquid ejection head for printing of this kind is a full line type head having a nozzle row in which a plurality of ejection ports (nozzles) are arranged through a length corresponding to the full width of the recording medium. In this case, a mode may be adopted in which a plurality of relatively short ejection head modules having nozzles rows which do not reach a length corresponding to the full width of the recording medium are combined and joined together, thereby forming nozzle rows of a length that correspond to the full width of the recording medium.

A full line type head is usually disposed in a direction that is perpendicular to the relative feed direction (relative conveyance direction) of the recording medium, but a mode may also be adopted in which the head is disposed following an oblique direction that forms a prescribed angle with respect to the direction perpendicular to the conveyance direction.

The "recording medium" indicates a medium which receives the deposition of ink ejected from the ejection ports of a liquid ejection head (this medium may also be called a print medium, image forming medium, recording medium, image receiving medium, ejection receiving medium, or the like). This term includes various types of media, irrespective of material and size, such as continuous paper, cut paper, sealed paper, resin sheets such as OHP sheets, film, cloth, a printed circuit board on which a wiring pattern, or the like, is formed, and an intermediate transfer medium, and the like.

Modes of the movement device for causing the recording medium and the liquid ejection head to move relatively to each other may include a mode where the recording medium is conveyed with respect to a stationary (fixed) head, a mode where a head is moved with respect to a stationary recording medium, and a mode where both the head and the recording medium are moved. When a color image is formed by means of an inkjet print head, it is possible to provide print heads which each are provided for each color of a plurality of ink colors (recording liquid colors), or it is possible to eject inks of a plurality of colors, from one print head.

According to the present invention, it is possible to strip off an air bubble adhering to the wall surface of the common flow channel, by means of the movable member, and therefore, air bubble removal characteristics can be improved.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment, Structure of Liquid Ejection Head

Figure 1:
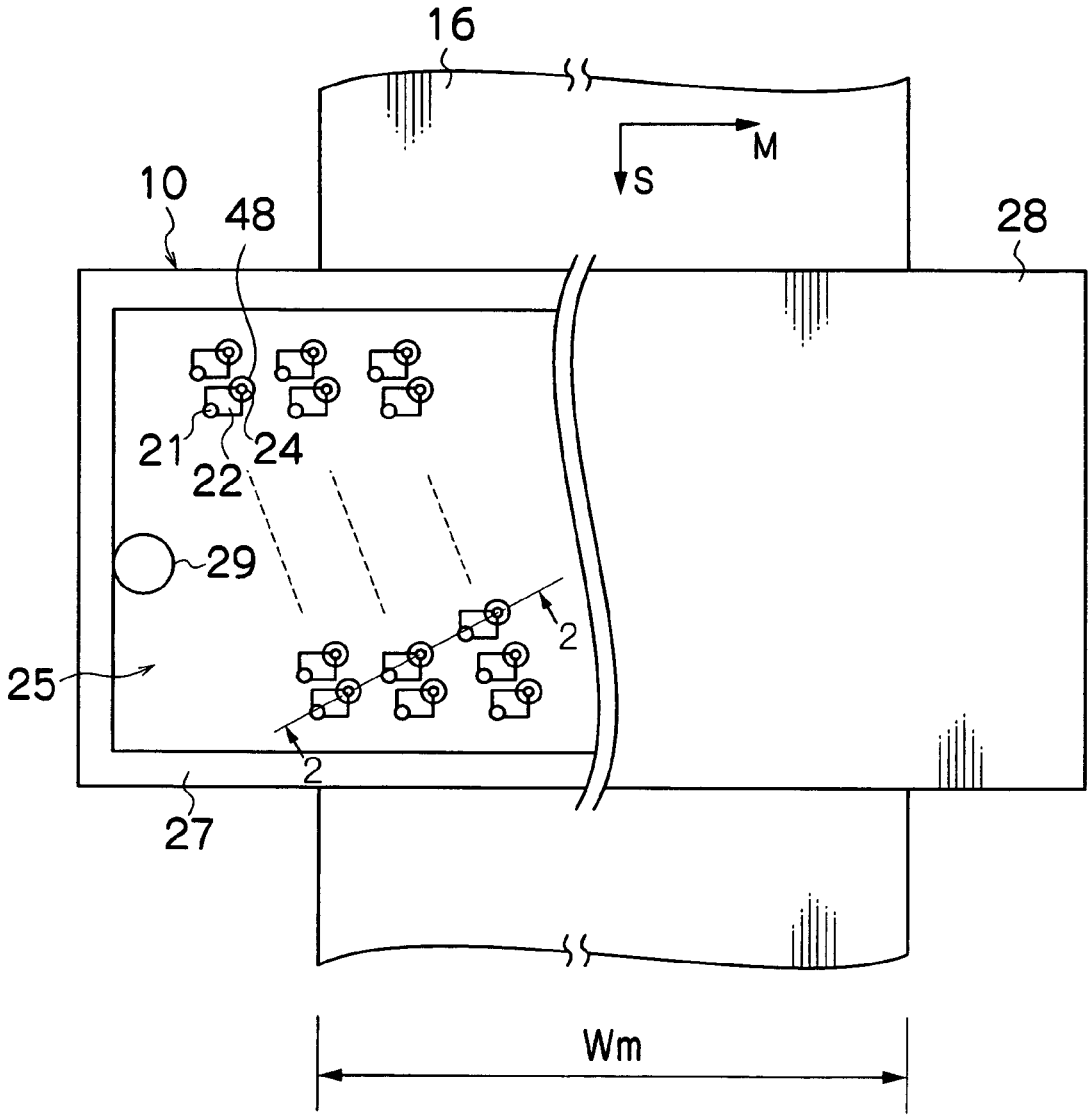
FIG. 1 is a plan diagram including a partial perspective diagram showing a schematic drawing of the structure of a liquid ejection head according to a first embodiment of the present invention.
Figure 2:
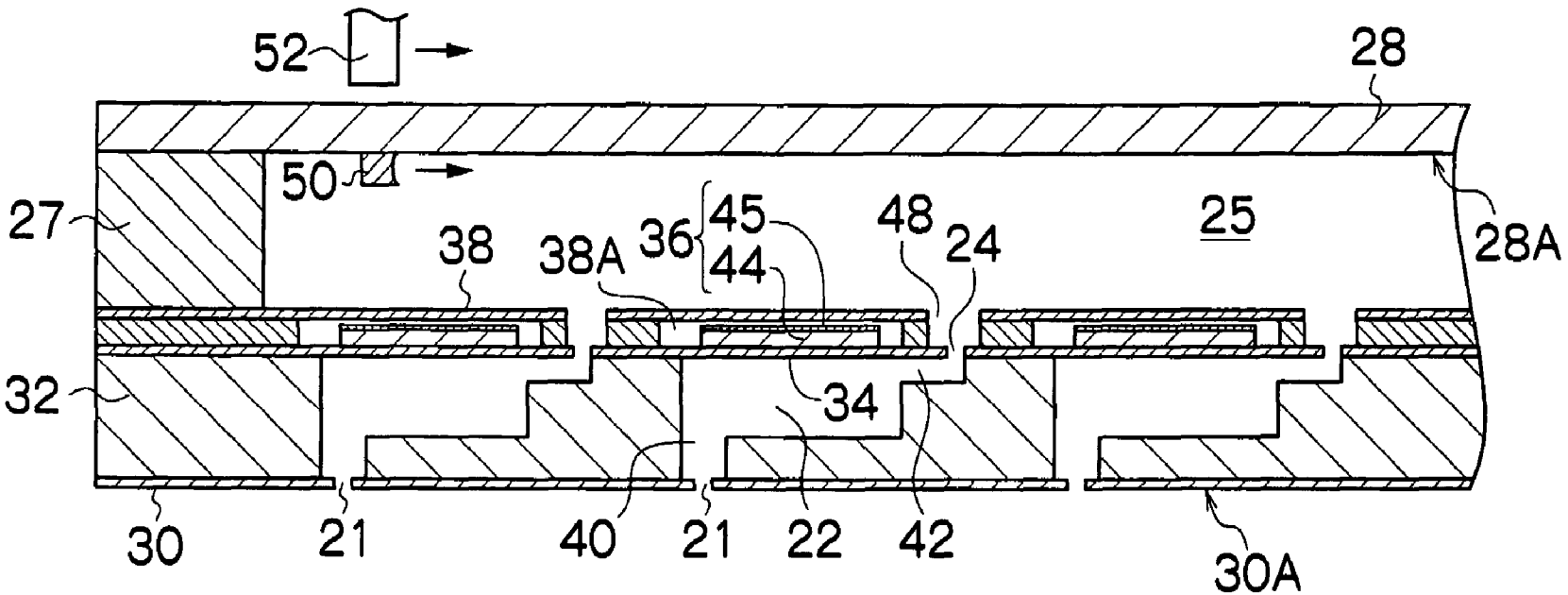
FIG. 2 is a cross-sectional diagram along line 2-2 in FIG. 1.

FIG. 1 is a plan diagram including a partial perspective diagram showing a schematic drawing of the structure of a liquid ejection head used in a liquid ejection apparatus relating to an embodiment of the present invention, and FIG. 2 is a cross-sectional diagram along line 2-2 in FIG. 1.

The head 10 shown in FIG. 1 is a full line type of print head used in an inkjet recording apparatus (also called a recording head or a print head), and it has a structure in which a plurality of nozzles 21 are arranged in a two-dimensional matrix configuration through a length corresponding to the full width Wm of the recording medium 16 in a direction (main scanning direction: indicated by arrow M) which is perpendicular to the conveyance direction of the recording medium 16 (the sub-scanning direction: indicated by arrow S). In FIG. 1, reference numeral 22 denotes a pressure chamber corresponding to a nozzle 21, and 24 denotes an ink supply port. A common flow channel 25 for supplying ink to the pressure chambers 22 is provided on the upper side of the plurality of the pressure chambers 22 (the upward vertical direction from the plane of the drawing in FIG. 1). Reference numeral 27 denotes a flow channel forming member (common flow channel forming substrate) forming the side wall sections of the perimeter of the common flow channel 25.

Furthermore, a supply system connection port 29 for introducing ink into the common flow channel 25 is formed in a suitable position (for example, the left-hand end section in the embodiment in FIG. 1) of the plate member which seals off the ceiling of the common flow channel 25 (the sealing substrate 28 which forms the ceiling of the common flow channel 25). An ink tank is connected to the supply system connection port 29 via a required tubing channel.

As shown in FIG. 1, the planar shape of the pressure chamber 22 provided corresponding to each nozzle 21 is substantially a square shape, and an outlet port to the nozzle 21 is provided at one of the ends of the diagonal line of the planar shape, while an inlet port (ink supply port) 24 for supplying ink is provided at the other end thereof. In implementing an embodiment of the present invention, the shape of the pressure chamber 22 is not limited to that of the present embodiment and various modes are possible in which the planar shape is a quadrilateral shape (such as diamond shape, rectangular shape, or the like), a pentagonal shape, a hexagonal shape, or other polygonal shape, or a circular shape, elliptical shape, or the like.

The common flow channel 25 shown in this embodiment is constituted as one large space formed over the whole region in which the pressure chambers 22 are formed, in such a manner that ink is supplied to all of the pressure chambers 22, but it is not limited to being formed as a single space (ink pool) in this way. The common liquid chamber 25 may also be divided into several regions to form a plurality of chambers, and a prescribed flow channel structure capable of restricting the ink flow may be adopted.

FIG. 2 is a cross-sectional diagram along line 2-2 in FIG. 1. As shown in FIG. 2, the liquid ejection head 10 according to the present embodiment has a structure in which a nozzle plate 30, a pressure chamber forming member 32, a diaphragm 34, piezoelectric elements 36, an intermediate plate 38, a common flow channel forming member 27 and a sealing substrate 28 are superimposed and bonded together.

Holes for the plurality of nozzles 21 corresponding to the ink ejection ports are formed in the nozzle plate 30. Furthermore, a lyophobic layer (not shown) is provided on the nozzle surface 30A, with a view to improving ejection stability and the cleaning properties of the ejection surface (nozzle surface 30A). There are no particular restrictions on the method for imparting lyophobic properties to the nozzle surface 30A (the lyophobic process method), and possible methods include, for example, a method involving coating of a fluorine-based lyophobic material, and a method involving the formation of a thin layer on the nozzle surface by vapor deposition of a lyophobic material, such as particles of a fluorine-based high polymer (PTFE), in a vacuum.

The pressure chamber forming member 32 is a flow channel forming member which is formed with spaces for pressure chambers 22, connecting channels 40 (nozzle flow channels) which connect the pressure chambers 22 to the nozzles 21, and a portion of the individual supply channels 42 which lead ink from the common flow channel 25 on the ink supply side to the pressure chambers 22.

The pressure chamber forming member 32 may be constituted by a single plate member formed with prescribed flow channel-shaped sections (openings and grooves, etc.), and it may also be constituted by a laminated body in which a plurality of plate members formed with openings and grooves (recess sections) for creating prescribed flow channel-shaped sections are superimposed and bonded together.

The diaphragm 34 is a member which forms a portion of the walls of the pressure chambers 22 (in FIG. 2, the ceiling). The diaphragm 34 is made of a conductive material, such as stainless steel (SUS), and it also serves as a common electrode for a plurality of piezoelectric elements 36. A mode is also possible in which a diaphragm is formed by a non-conductive material such as resin, and in the mode, a common electrode layer made of a conductive material such as metal is formed on the surface of the diaphragm member.

Piezoelectric bodies 44 are provided on the surface of the diaphragm 34 on the opposite side of the diaphragm 34 from the side of the pressure chambers 22 (in FIG. 2, the upper side), at positions corresponding to the respective pressure chambers 22; and individual electrodes 45 are formed on the upper surfaces of the piezoelectric bodies 44 (the surfaces on the opposite side of the piezoelectric bodies 44 from the surface contacting the diaphragm 34, which also serves as a common electrode). A piezoelectric element 36 (corresponding to an "actuator") is formed by an individual electrode 45, the common electrode opposite to the individual electrode 45 (which the diaphragm 34 also serves as in this embodiment), and a piezoelectric body 44 interposed so as to be sandwiched between these electrodes. A piezoelectric material, such as lead titanate zirconate or barium titanate, is suitable for use as the piezoelectric bodies 44.

The intermediate plate 38 functions as a cover plate and a spacer member which covers the upper portion of the piezoelectric elements 36 and ensures displacement spaces for the respective piezoelectric elements 36, and thus it serves as a protection of the piezoelectric elements 36 against the common flow channel 25 (thereby preventing contact with the ink). The piezoelectric elements 36 produce a warping distortion in the thickness direction or a change in the thickness direction, thereby displacing the diaphragm 34. Hence, a space which permits this deformation is required above each piezoelectric element 36. Therefore, recess sections 38A corresponding to the piezoelectric elements 36 are formed in the intermediate plate 38, each of the piezoelectric elements 36 is accommodated between the diaphragm 34 and each of the recess sections 38A, and hence a prescribed space is ensured about the periphery of each piezoelectric element 36.

There are no particular limitations on the modes of the drive wires for driving the piezoelectric elements 36; for example, the drive wires for driving the piezoelectric elements 36 may be horizontal wires which are formed by patterning electrical wires (internal wires) onto the intermediate plate 38 so as to run in parallel with the surface of the intermediate plate 38.

The intermediate plate 38 in the present embodiment is a member which forms a portion of the surface of the common flow channel 25 (in FIG. 2, the floor member which forms the bottom surface of the common flow channel 25). In order to supply ink to the pressure chambers 22 from the common flow channel 25, ink flow channels 48 which pass through the intermediate plate 38 are formed so as to correspond to the positions of the pressure chambers 22, and ink supply ports 24 which serves as ink restrictors (narrowest sections) are formed in the diaphragm 34. The ink flow channels 48 are formed substantially perpendicularly with respect to the plane of the diaphragm 34, and the common flow channel 25 and the pressure chambers 22 are connected by means of the ink flow channels 48, the ink supply ports 24 and the individual supply channels 42.

From the viewpoint of liquid resistance, an insulating and protective film (not shown) made of resin, or the like, is formed on the portions of the surface of the intermediate plate 38 which make contact with the ink inside the common flow channel 25.

The common flow channel forming member 27 is bonded onto the upper surface of the intermediate plate 38 described above (the surface on the opposite side to the diaphragm 34). The common flow channel forming member 27 is a flow channel forming member (wall member) provided with sections which form side wall portions forming a space for the common flow channel 25 which accumulates ink.

The common flow channel forming member 27 may be constituted by a single plate member formed with prescribed flow channel-shaped sections (openings and grooves, etc.), and it may also be constituted by a laminated body in which a plurality of plate members formed with openings and grooves (recess sections) for creating prescribed flow channel-shaped sections are superimposed and bonded together.

In the composition described above, when a drive voltage is applied between an individual electrode 45 and the common electrode (which the diaphragm 34 serves as), the corresponding piezoelectric element 36 deforms, thereby changing the volume of the corresponding pressure chamber 22. This causes a pressure change which results in ink being ejected from the corresponding nozzle 21. When the displacement of the piezoelectric element 36 returns to its original position after the ejection of ink, the pressure chamber 22 is replenished with new ink from the common flow channel 25, via the ink supply port 24.

As described above, according to the present embodiment, the structure is achieved in which the common flow channel 25 is disposed on the upper side of the diaphragm 34 (the opposite side to the pressure chambers 22), and ink is supplied to the pressure chambers 22 in lower positions by means of the ink flow channels 48 passing in a substantially perpendicular direction through the diaphragm surface. Therefore, it is possible to reduce the flow channel resistance on the supply side, and hence ink refill characteristics can also be improved.

Furthermore, as shown in FIG. 2, inside the common flow channel 25, a movable member (air bubble stripping member) 50 is provided, movably along a portion of the flow channel wall of the common flow channel (which, in this embodiment, corresponds to the lower surface of the sealing member 28 which constitutes the ceiling face of the common flow channel 25; and which is also called "flow channel wall 28A" hereinafter). The movable member 50 is constituted partially or wholly by a ferromagnetic body, and a magnetic field generating device 52 is provided outside of the common flow channel 25 as a device which moves this movable member 50. The magnetic field generating device 52 is constituted by an electromagnet or a permanent magnet.

The magnetic field generation device 52 is supported movably by a drive mechanism (not shown). The device which moves the magnetic field generation device 52 may be a drive device which uses an electric motor-driven type of power source, such as a motor, and it may also be a device based on the amount of movement of a manual operating member (a lever, dial, or the like). Furthermore, for the device for transmitting the power, it is possible to use a commonly known mechanism, such as a gear transmission mechanism or a wound transmission mechanism, or a suitable combination of these.

Figure 3:
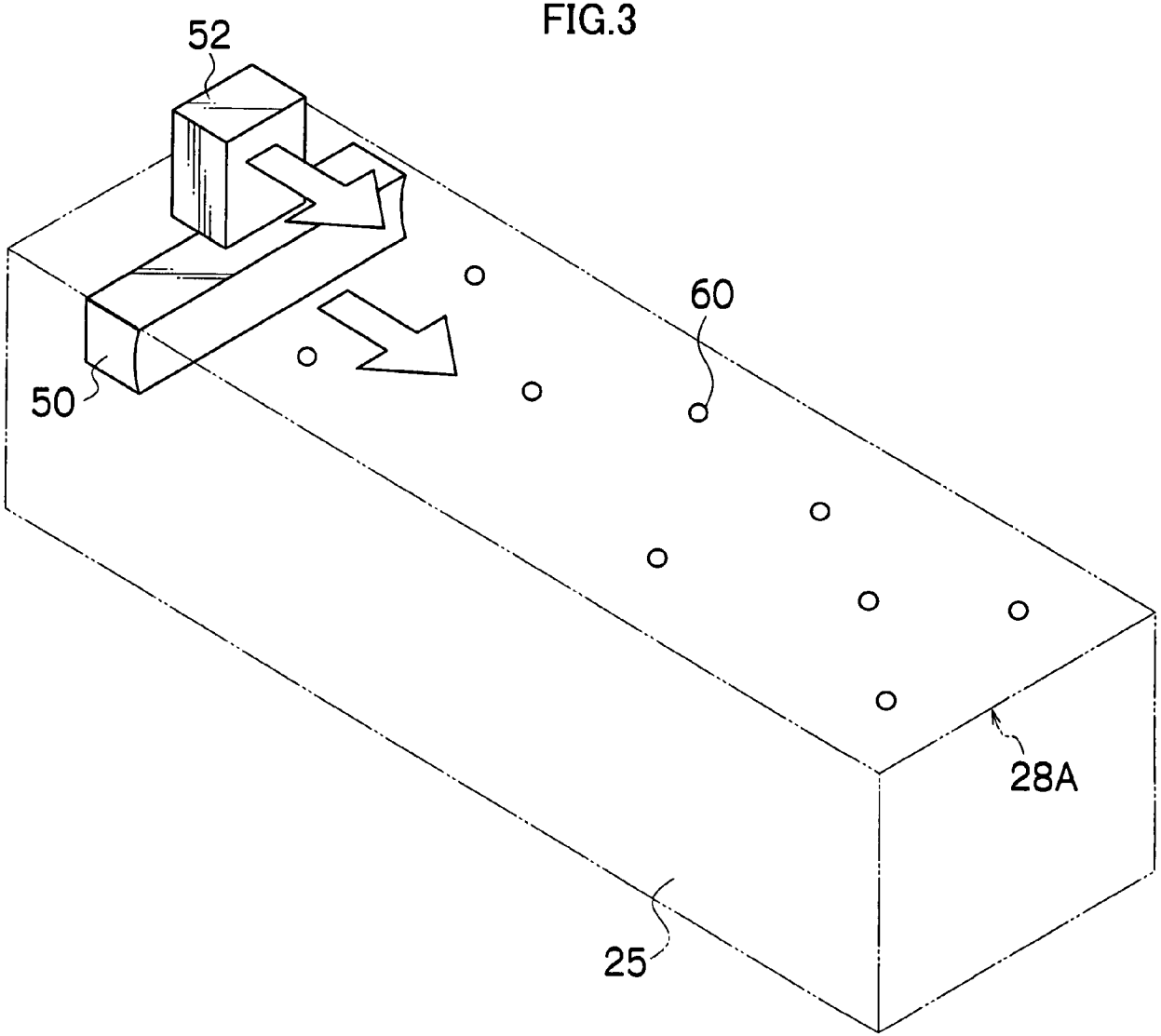
FIG. 3 is an oblique perspective diagram showing a principal composition of the liquid ejection head shown in FIG. 1.

As shown in FIG. 3, the movable member 50 in the present embodiment is a bar-shaped member having a length which is substantially equal to the width (the shorter width) of the common flow channel 25 in the breadthways direction (sub-scanning direction), and it slides over the flow channel wall 28A of the common flow channel 25 in conjunction with the movement of the magnetic field generating device 52, in a state of contact with the flow channel wall 28A due to the magnetic force of the magnetic field generating device 52. The movable member 50 advances while stripping off air bubbles 60 adhering to the flow channel 28A and collecting these air bubbles 60.

Desirably, a flow channel for expelling air bubbles to the exterior (for example, a circulating channel, a dummy nozzle, or the like) is provided at a place toward which the movable member 50 advances, in order to expel the air bubbles to the exterior via it.

Figure 4:
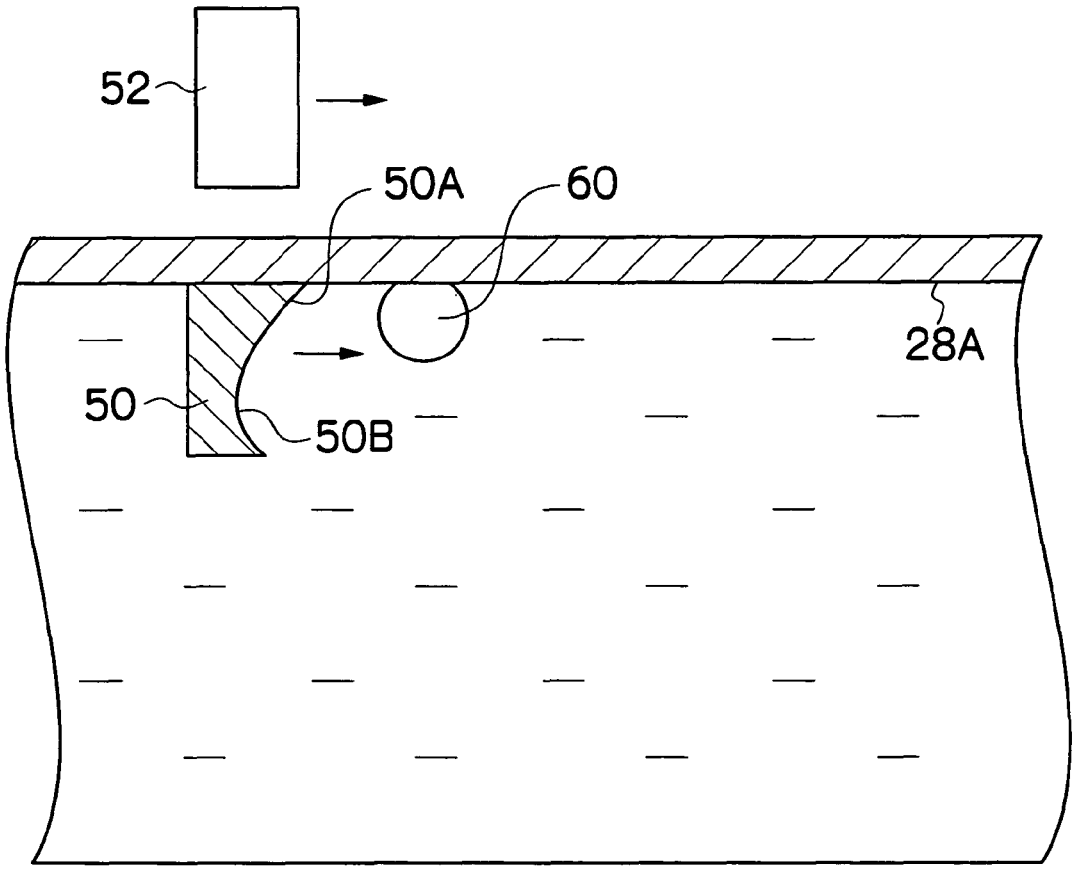
FIG. 4 is a side view diagram showing a principal composition of the liquid ejection head shown in FIG. 1.

There are no particular restrictions on the shape of the movable member 50. For example, as shown in FIG. 4, the structure which includes: a (wedge-shaped) oblique surface section 50A having an acute angle which readily enters into gaps between the flow channel wall 28A and the air bubbles 60; and a hollow section 50B which holds and retains the air bubbles 60 stripped off from the flow channel wall 28A, is desirable.

Desirably, the movable member 50 is formed from a material having high hydrophilic properties, or it is processed with a hydrophilic surface treatment. The device for moving the movable member 50 may be automatically controlled or it may be manually controlled.

In FIG. 3, the movable member 50 is moved in the lengthwise direction of the common flow channel 25, but the direction of movement of the movable member 50 is not limited to this embodiment. It is also possible to adopt a mode in which a movable member having a length substantially equal to the width of the common flow channel 25 in the lengthwise direction (main scanning direction) is used and the movable member is moved in the breadthways direction (sub-scanning direction). In this case, the movement distance of the movable member is shortened.

Figure 5:
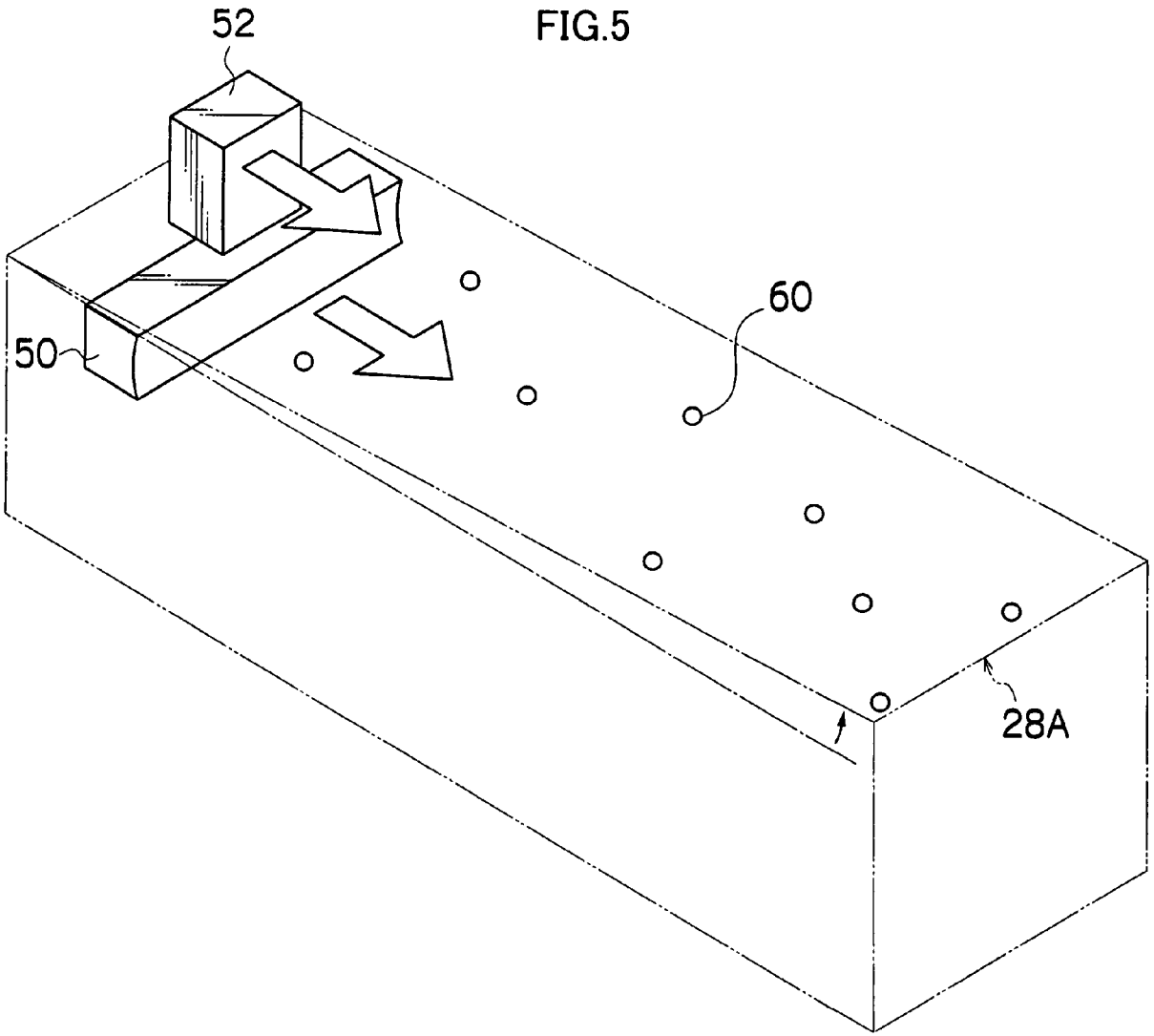
FIG. 5 is a principal oblique perspective diagram showing a further embodiment of the composition of the liquid ejection head shown in FIG. 1.

Furthermore, since the air bubbles 60 travel upward in the flow channel, then as shown in FIG. 5, a desirable composition is one having an oblique surface structure in which the ceiling wall surface of the common flow channel 25 (flow channel wall 28A) gradually becomes higher in terms of the direction in which the air bubbles are to be expelled (in this embodiment, the direction of the white arrows in FIG. 5).

Second Embodiment

Figure 6:
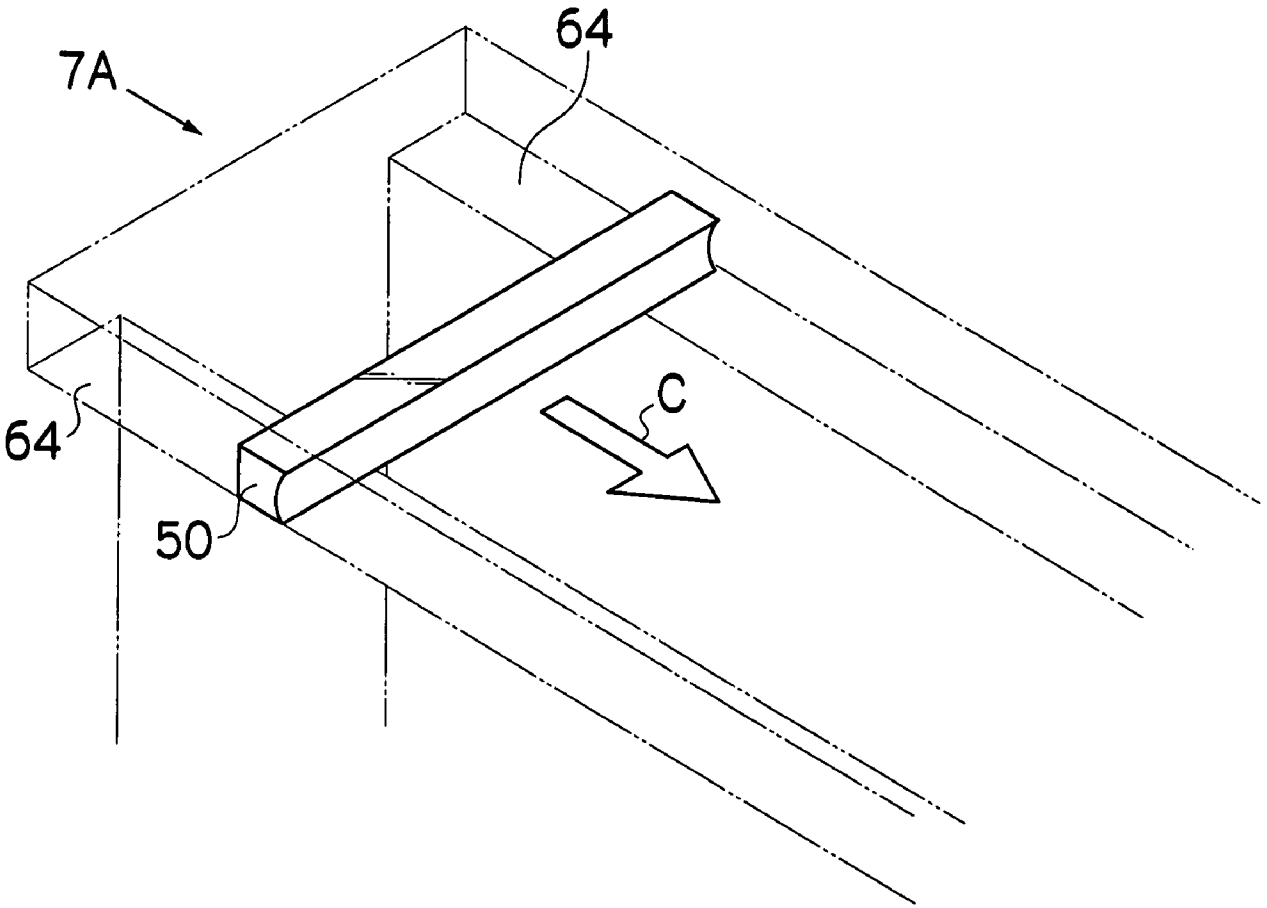
FIG. 6 is an oblique perspective diagram showing a principal composition of a liquid ejection head according to a second embodiment of the present invention.
Figure 7:
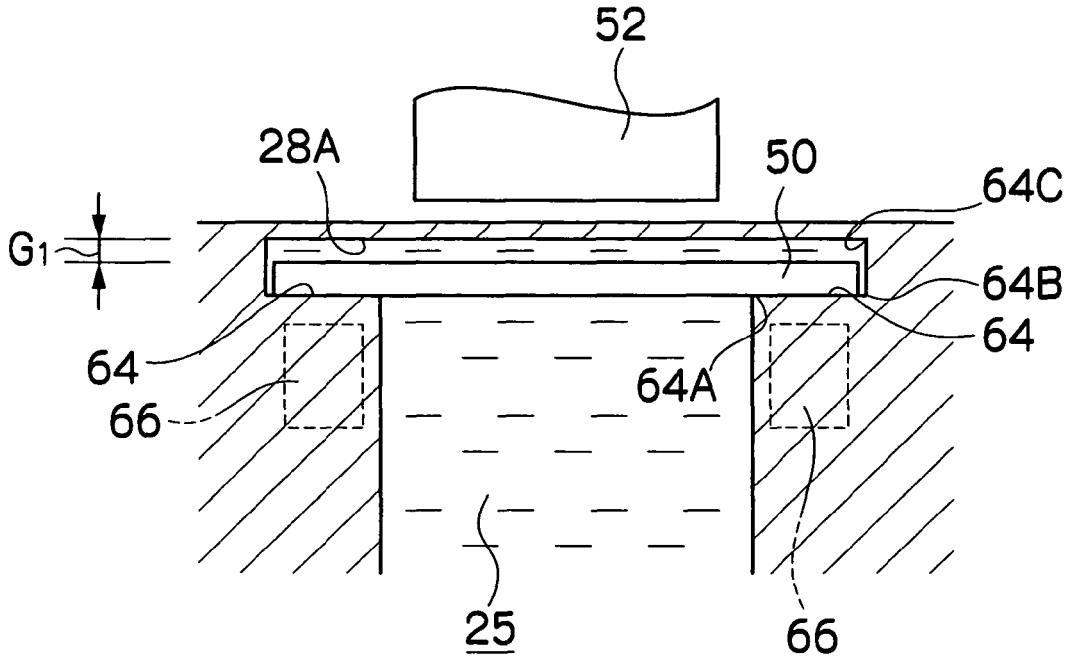
FIG. 7 is a side view diagram viewed in the direction of arrow 7A in FIG. 6.

FIG. 6 is an oblique perspective diagram showing the principal part of a second embodiment, and FIG. 7 is a diagram viewed from the direction of arrow 7A in FIG. 6. As shown in FIGS. 6 and 7, in this second embodiment, holding sections 64 which are able to support the respective end sections of the movable member 50 are formed so as to be able to hold the movable member 50, in a portion of the common flow channel 25 (the vicinity of the ceiling face).

As shown in FIG. 7, the lower surfaces of the respective end sections of the movable member 50 make contact with the holding sections 64, and the movable member 50 is held in a state where it is spanned between the holding sections 64 and 64. When the movable member 50 is held in this state, a gap G1 is formed between the movable member 50 and the flow channel wall 28A, and hence the movable member 50 does not make contact with the flow channel wall 28A.

If the magnetic field created by the magnetic field generation device 52 is switched off, then the movable member 50 falls downward under its own weight (due to the force of the gravity), and it is caught and held by the holding sections 64. In other words, if the magnetic field created by the magnetic field generation device 52 is off, the movable member 50 can be held by the holding sections 64. In this embodiment, a composition is adopted in which magnetic field generation devices 66 which each generate a magnetic field is disposed below the holding sections 64, in such a manner that a force can be applied to pull the movable member 50 in the downward direction in FIG. 7 by means of the magnetic force of each magnetic field generation device 66, thereby causing the movable member 50 to make contact with the holding sections 64.

By controlling the generation of the magnetic field by means of the magnetic field generation devices 52 and 66, it is possible to simply switch between a state where the movable member 50 is in contact with the flow channel wall 28A and a state where it is not in contact with same.

The magnetic field generation device 52 situated above the common flow channel 25 is used for moving the movable member 50 while pressing the movable member 50 against the flow channel wall 28A, as shown in FIGS. 3 and 4. Furthermore, in FIG. 7, the magnetic field generation devices 66 disposed below the holding sections 64 are used in order to move the movable member 50 without making contact with the flow channel wall 28A (in a state where the movable member 50 makes contact with the holding sections 64).

For example, if it is desired to collect and move the air bubbles in one fixed direction (the direction of arrow C in FIG. 6), then the magnetic field generation devices 52 and 66 are switched respectively between the forward and backward movements. In other words, when the movable member 50 proceeds in the direction of the arrow C in FIG. 6, the movable member 50 is pulled in contact with the ceiling face of the common flow channel 25 by the magnetic force of the magnetic force generation device 52, which is situated on the upper side of the movable member 50 in FIG. 7. Conversely, when the movable member 50 returns in the opposite direction to arrow C, then the movable member 50 is pulled toward the holding sections 64 by the magnetic force generation devices 66, which are situated below the movable member 50. By adopting this composition, it is possible to push and collect the air bubbles in one fixed direction (in this case, the direction of arrow C in FIG. 6).

In FIGS. 6 and 7, for the sake of convenience, the corner portions 64A to 64C of the holding sections 64 are square shaped (see FIG. 7); however, desirably, each of the corner portions 64A to 64C is given a suitable curvature (so that the corner portions have a smooth curved shape), in such a manner that air bubbles do not stagnate readily in the holding sections.

Third Embodiment

Figure 8:
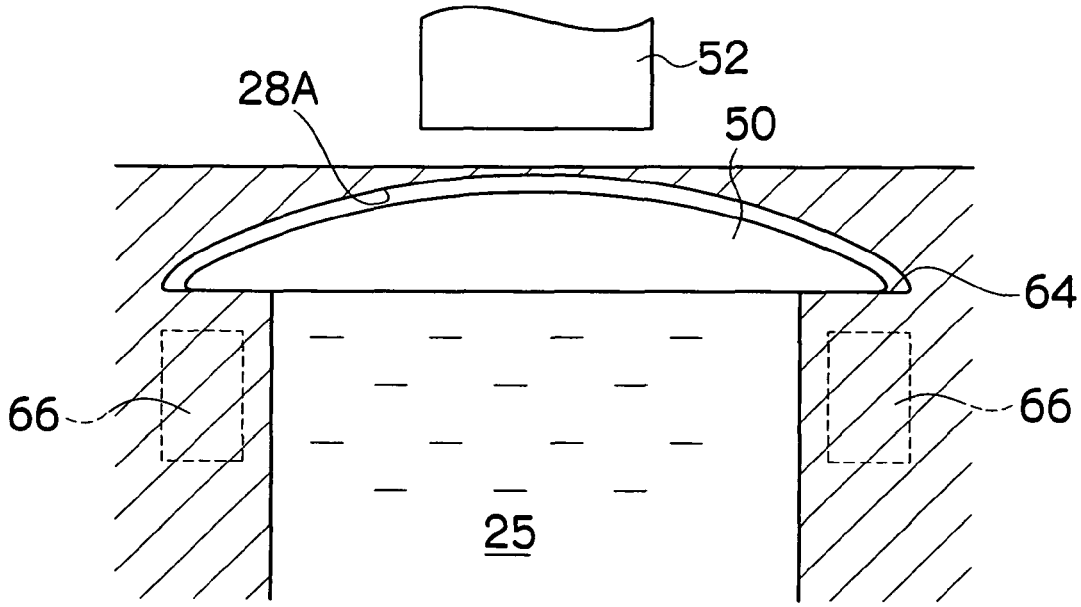
FIG. 8 is a principal schematic drawing of a liquid ejection head according to a third embodiment of the present invention.

FIG. 8 is a schematic drawing showing the principal composition of a third embodiment. In this third embodiment, the flow channel wall 28A (in FIG. 8, the ceiling face of the common flow channel 25) along which the movable member 50 moves while making contact with same is formed with a curved shaped (a three-dimensional curved plane shape), as shown in FIG. 8. In other words, a substantially arc-shaped flow channel wall 28A having a variable height when viewed in the direction of movement of the movable member 50 (the perpendicular direction with respect to the plane of the drawing in FIG. 8) is formed.

The movable member 50 is also composed in a curved shape in accordance with the curved shape of the flow channel wall 28A, so as to follow the shape of the flow channel wall 28A. When the movable member 50 is made to contact the flow channel wall 28A due to the magnetic field created by the magnetic force generation device 52, the movable member 50 makes tight contact with the flow channel wall 28A because the shape of the movable member 50 coincides with the shape of the flow channel wall 28A.

Figure 9:
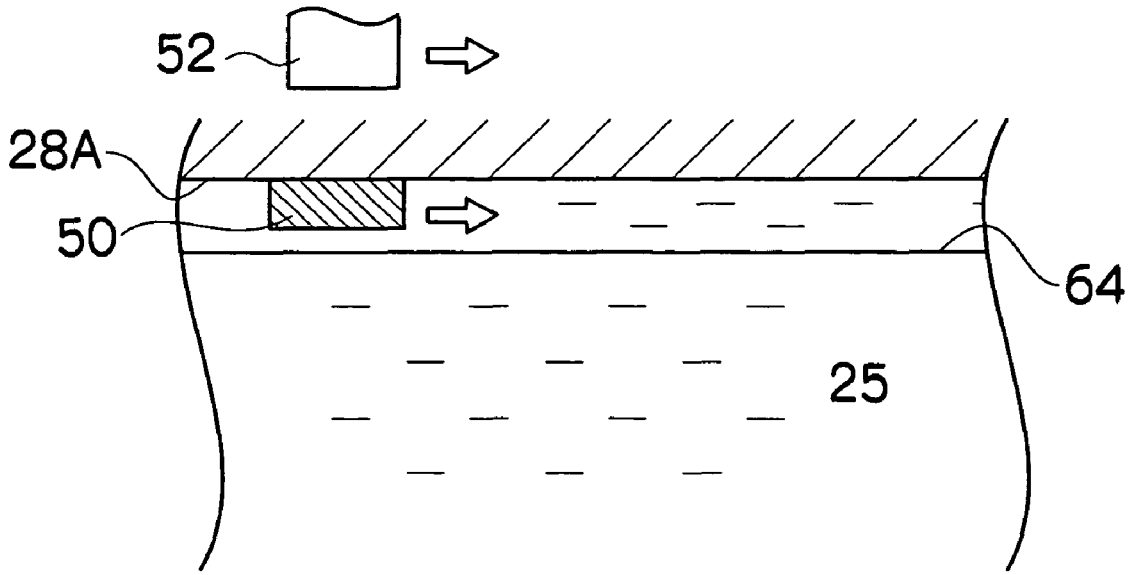
FIG. 9 is a cross-sectional side view of the composition shown in FIG. 8.

FIG. 9 is a sectional side view diagram of FIG. 8. As shown in FIG. 9, by making the movable member 50 contact the flow channel wall 28A due to the magnetic field by the magnetic force generation device 52, and then moving the magnetic force generation device 52, it is possible to make the movable member 50 move along the flow channel wall 28A.

Figure 10A:
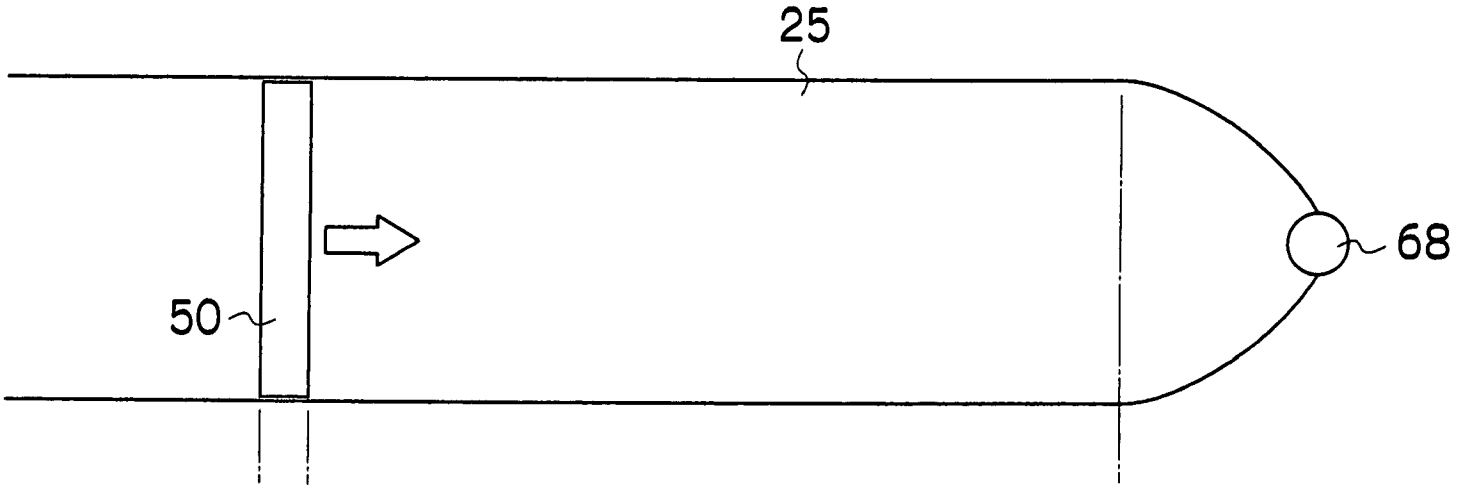
FIG. 10A is a plan diagram showing one embodiment of a common flow channel.
Figure 10B:
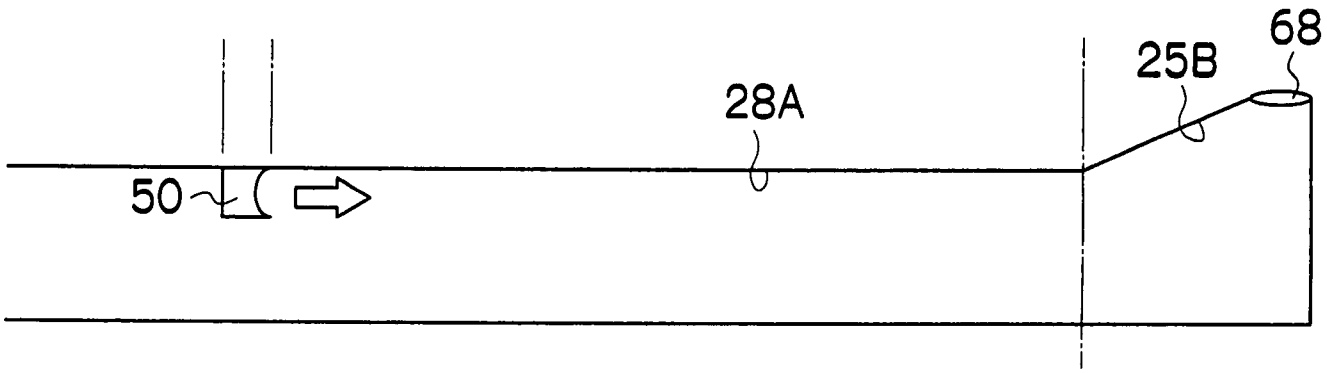
FIG. 10B is a side view diagram of the common flow channel shown in FIG. 10A.

In the case of the composition shown in FIGS. 8 and 9, air bubbles are liable to collect in the highest portion of the flow channel wall (ceiling face) 28A (in other words, the central portion in FIG. 8). Consequently, by forming a flow channel for air bubble removal (not shown) in this central portion, then the removal of air bubbles to the exterior is facilitated. Of course, if the air bubbles are collected at an end of the common flow channel 25 (the end section in the direction of travel of the movable member 50) as shown in FIGS. 10A and 10B, then an air bubble removal flow channel 68 is formed in the end section of the common flow channel 25. In this case, desirably, the ceiling face 25B at the end section of the common flow channel 25 in the direction of travel of the movable member 50 is formed as an oblique ceiling face which gradually becomes higher toward the end section, and the air bubble removal flow channel 68 is formed in the highest position of same.

Figure 11:
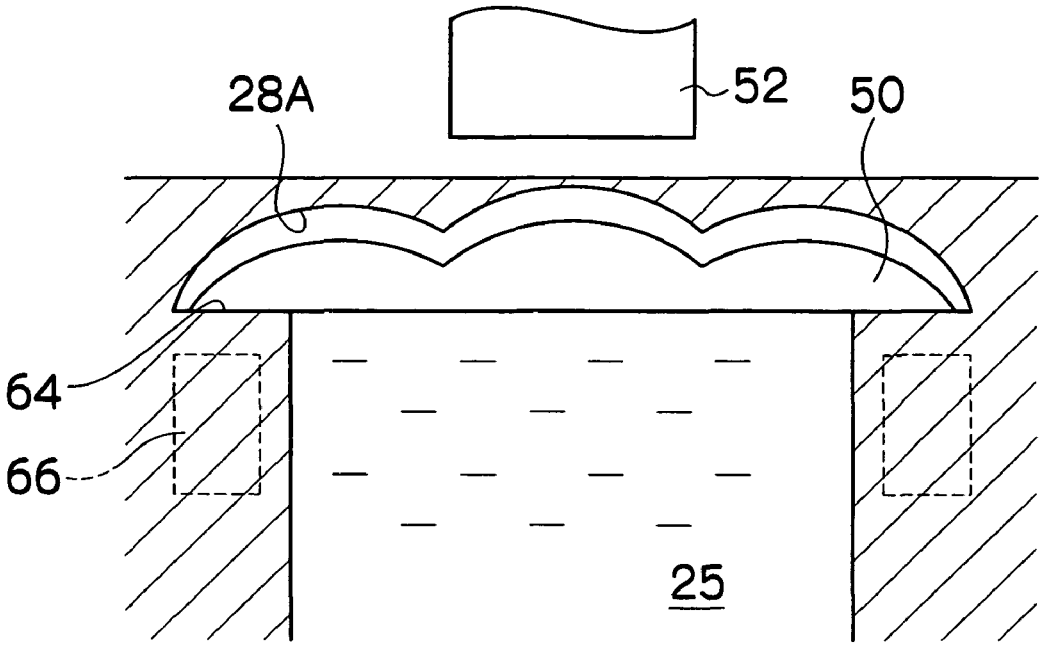
FIG. 11 is a principal schematic drawing showing a modification example of the composition shown in FIG. 8.

The flow channel wall 28A and the movable member 50 are not limited to having a substantially arc-shaped curved plane shape as shown in FIG. 8, as long as they have a so-called "hump" shape. Therefore, the flow channel wall 28A and the movable member 50 may have a substantially triangular shape, or a combination of straight lines and curved lines. Furthermore, the number of humps is not limited to one, and a plurality of the humps may be provided. For example, a three-humped shape such as that shown in FIG. 11 may be adopted. In FIG. 11, elements which are the same as or similar to those in FIG. 8 are labeled with the same reference numerals and description thereof is omitted here.

Fourth Embodiment

Figure 12:
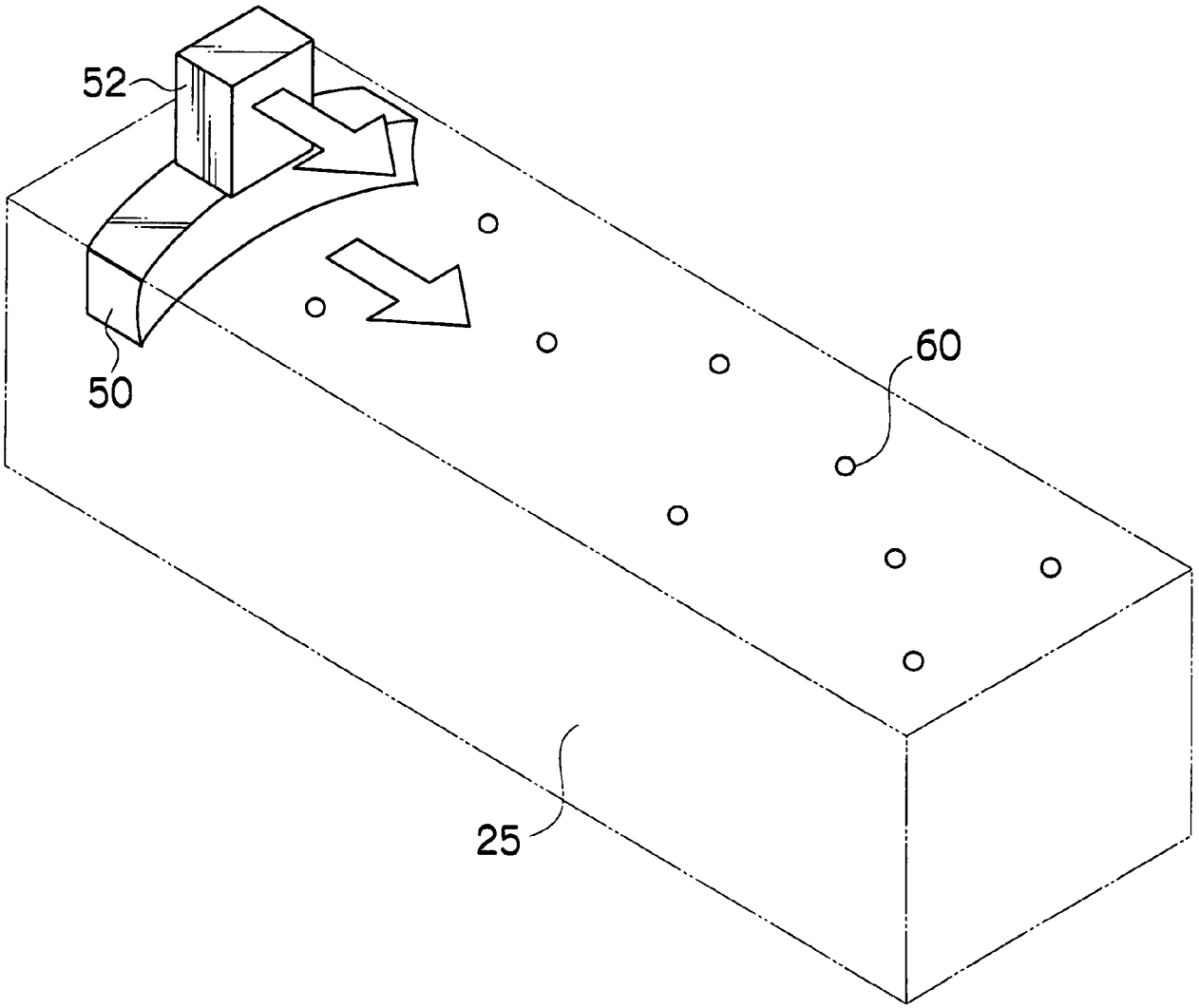
FIG. 12 is an oblique perspective diagram showing a principal composition of a liquid ejection head according to a fourth embodiment of the present invention.
Figure 13A:
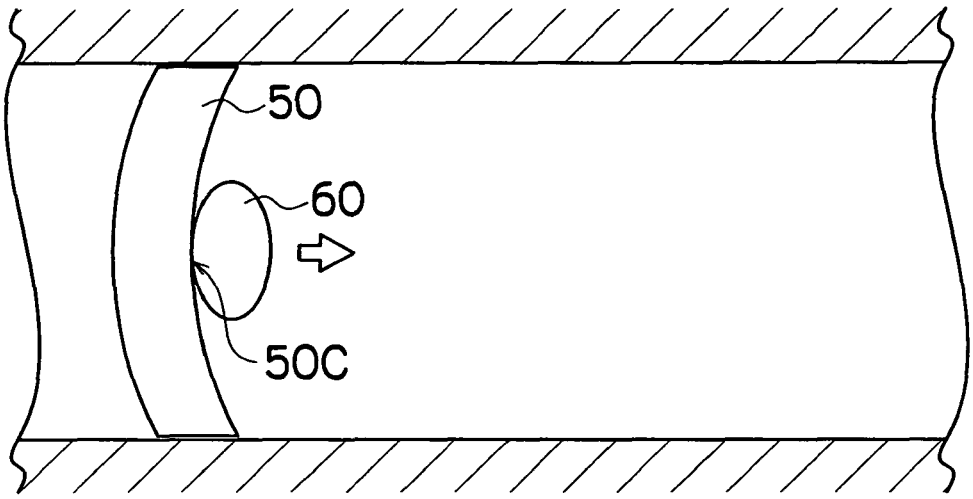
FIG. 13A is a plan diagram of the composition shown in FIG. 12.
Figure 13B:
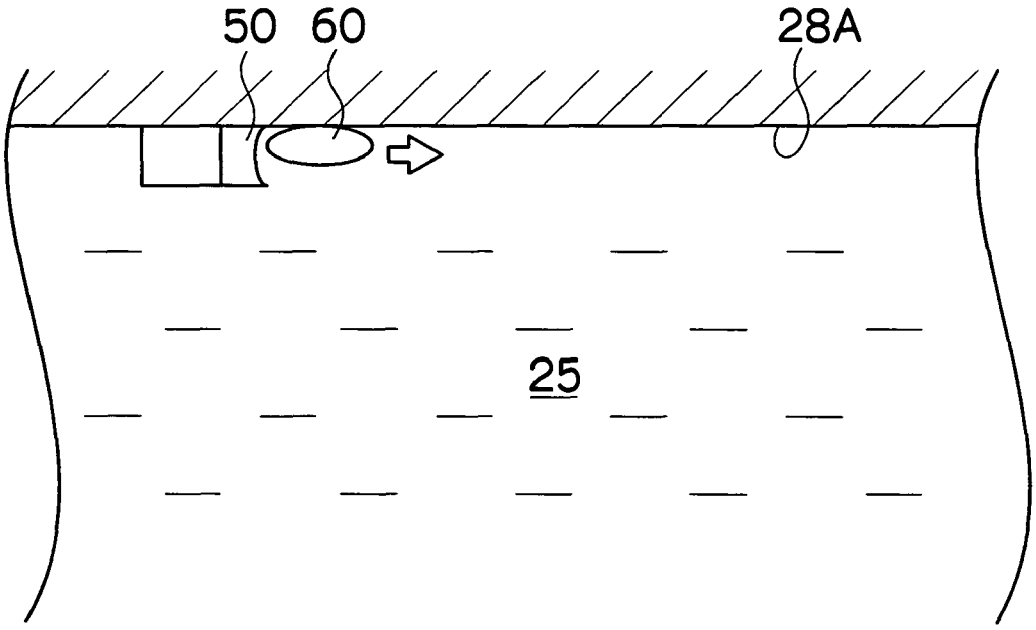
FIG. 13B is a side view diagram of same.

FIGS. 12 to 13B are schematic drawings showing the principal composition of a fourth embodiment. FIG. 12 is an oblique perspective diagram, FIG. 13A is a plan diagram and FIG. 13B is a side view diagram. In the fourth embodiment shown in these diagrams, rather than having a linear shape which is perpendicular with respect to its direction of travel, the movable member 50 has a curved recessed shape which is hollowed in the rearward direction with respect to the direction of travel.

By using this movable member 50 having this shape, the air bubbles 60 are gathered into the most rearward portion of the movable member 50 (the hollow portion 50C of the recess shape), and hence the air bubbles can be collected by the movable member 50. Desirably, a flow channel for removing air bubbles (a circulating flow channel, dummy nozzle, or the like), is formed at the end to which the movable member 50 moves.

By adopting a composition which combines the characteristics of the fourth embodiment and the characteristics of the third embodiment, in such a manner that the flow channel ceiling has a curved shape and the movable member also has a recessed shape in the forward direction of travel (a projecting shape in the direction contrary to the direction of travel), it is possible to collect the air bubbles with even greater efficiency.

Fifth Embodiment

Figure 14:
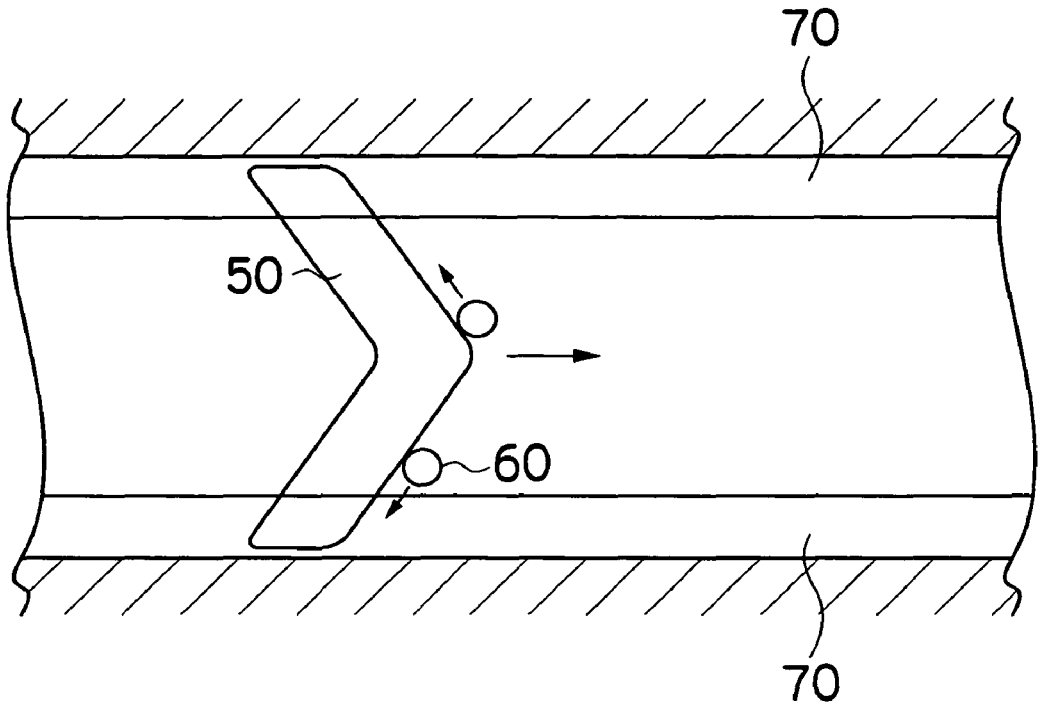
FIG. 14 is a plan diagram showing a principal composition of a liquid ejection head according to a fifth embodiment of the present invention.
Figure 15:
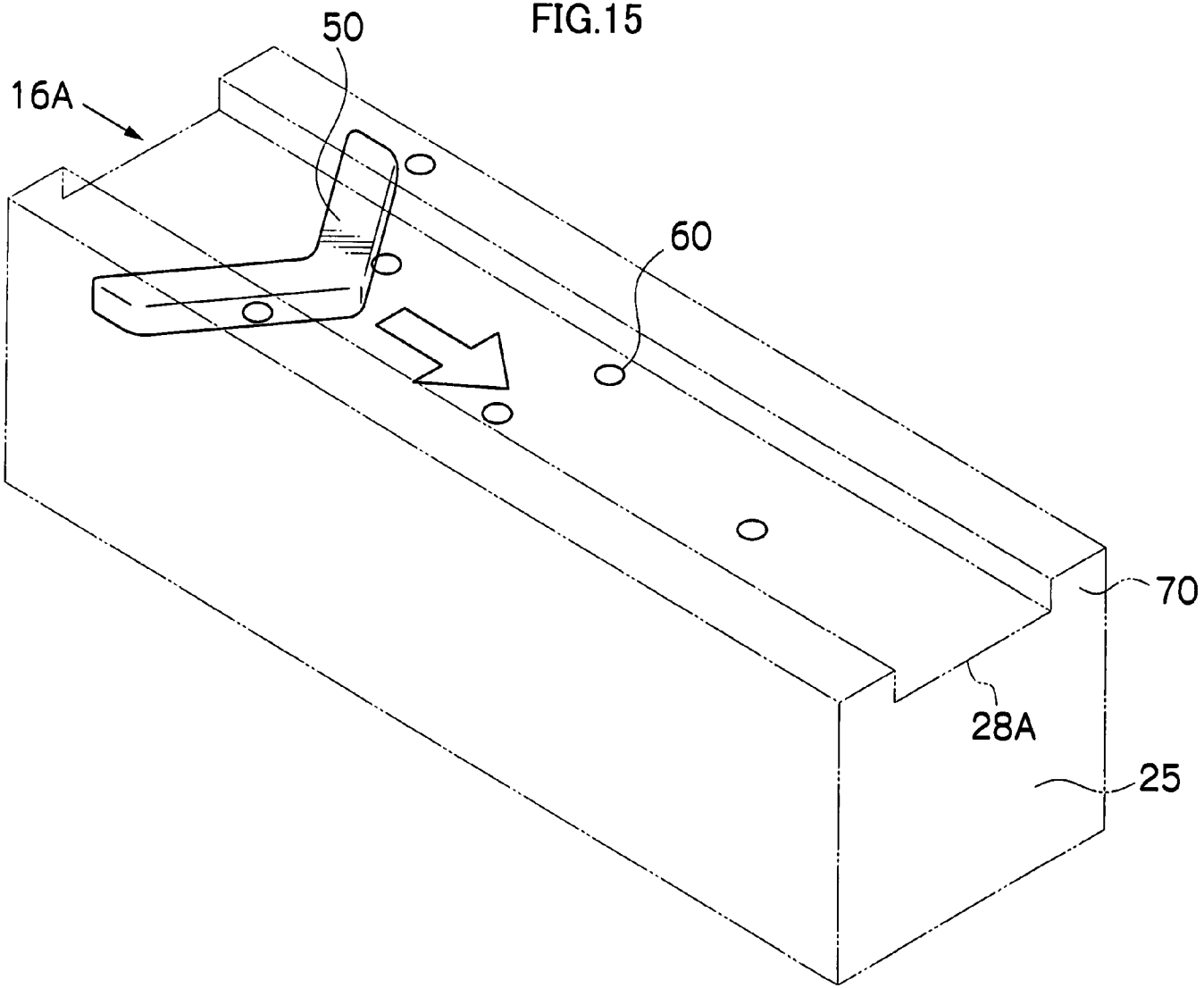
FIG. 15 is an oblique view of the composition shown in FIG. 14.
Figure 16:
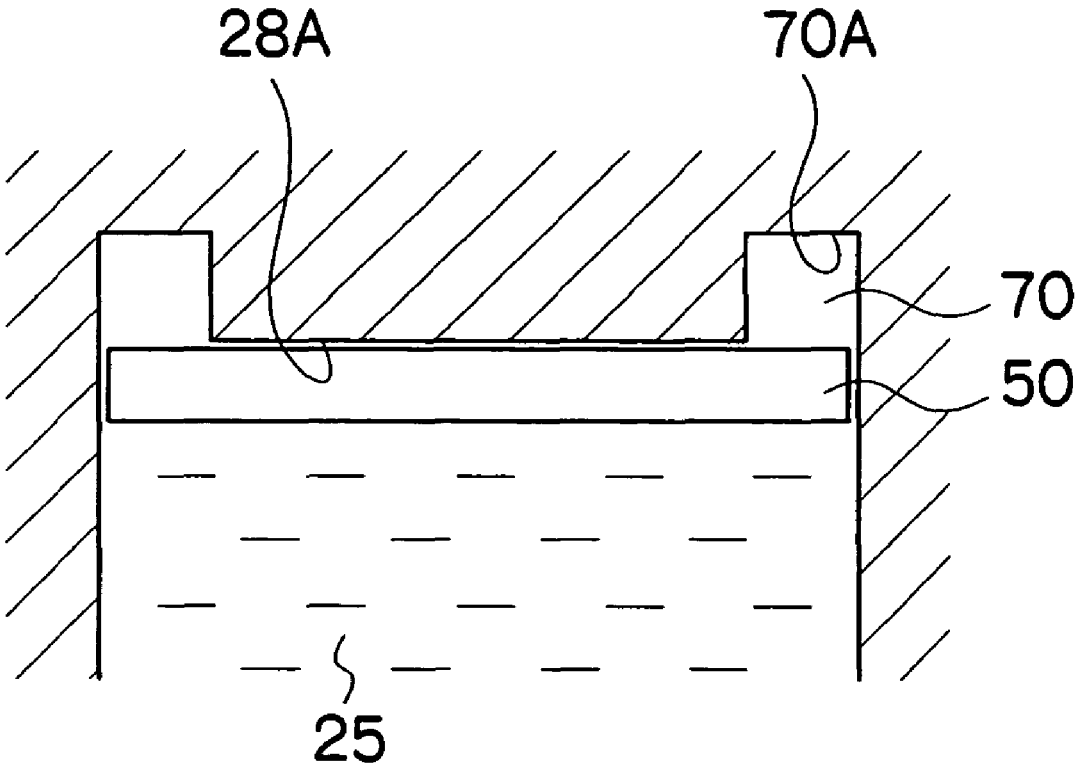
FIG. 16 is a side view diagram viewed in the direction of arrow 16A in FIG. 15.

FIGS. 14 to 16 are diagrams showing the principal part of a fifth embodiment, wherein FIG. 14 is a plan diagram, FIG. 15 is an oblique perspective diagram, and FIG. 16 is a side view diagram as viewed in the direction of arrow 16A in FIG. 15. As shown in these diagrams, the movable member 50 has a substantially V-shaped form which is bent in a projecting shape in the direction of travel of the member. Air bubble removing grooves 70, in which air bubbles 60 stripped from the flow channel wall 28A by the movable member 50 collect, are formed in the end sections of the common flow channel 25 which overlap with the respective end sections of the movable member 50.

With the movement of the movable member 50, the air bubbles 60 stripped from the flow channel wall 28A are moved to the ends of the common flow channel 25 following the oblique edges of the movable member 50, and the air bubbles 60 are moved into the air bubble removal grooves 70.

Figure 17:
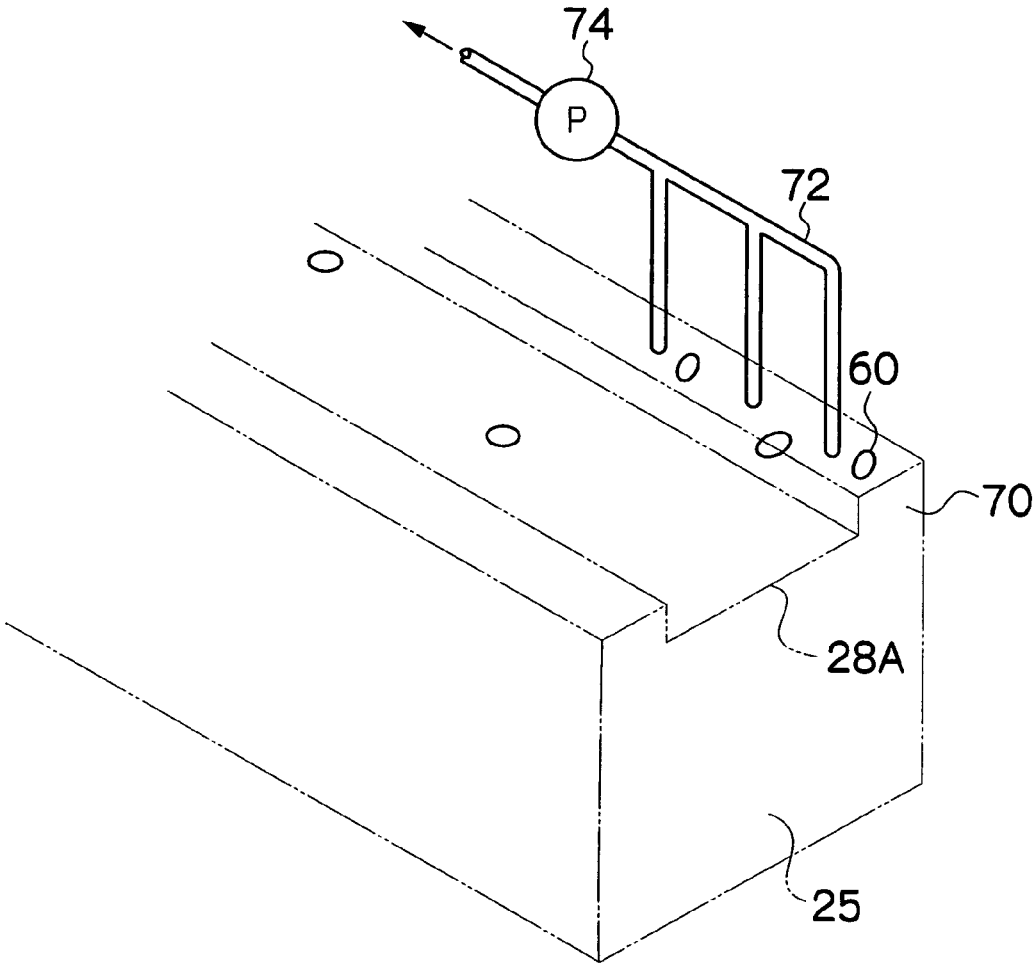
FIG. 17 is an oblique perspective diagram showing an additional composition according to the fifth embodiment.

As shown in FIG. 16, the ceiling surfaces 70A of the air bubble removal grooves 70 are formed at a higher position than the movable member 50, and hence the air bubbles collected in the grooves 70 become stagnated in the grooves 70. These grooves 70 are connected to a pump 74 via channels 72, as shown in FIG. 17. Consequently, a composition is adopted in which the air bubbles 60 collected in the grooves 70 are expelled to the exterior by means of the pump 74.

Sixth Embodiment

Figure 18:
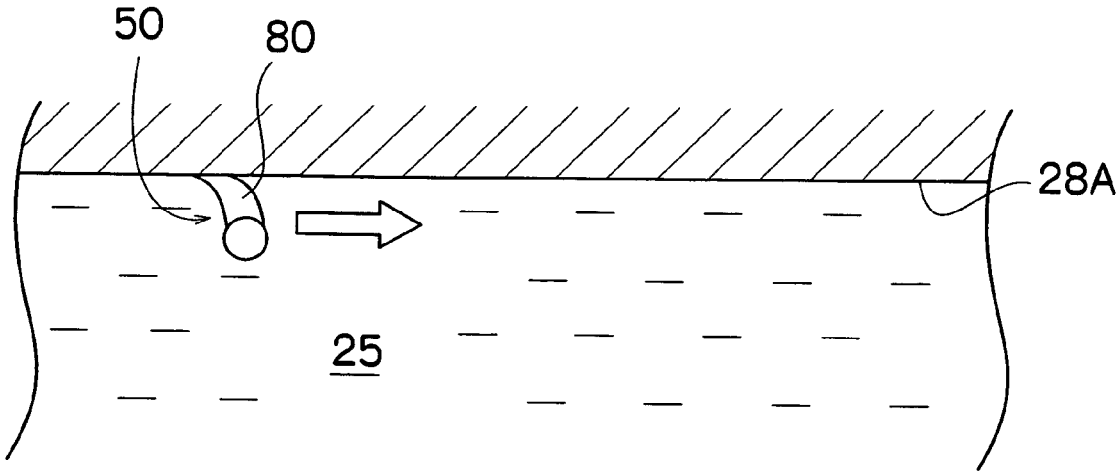
FIG. 18 is a side view diagram showing a principal composition of a liquid ejection head according to a sixth embodiment of the present invention.

FIG. 18 is a principal schematic drawing showing a sixth embodiment. As shown in FIG. 18, the portion of the movable member 50 which makes contact with the flow channel wall 28A is made of an elastic member 80 such as rubber. By using such an elastic member 80, it is possible to apply a force to the flow channel wall 28A without damaging the wall.

Figure 19:
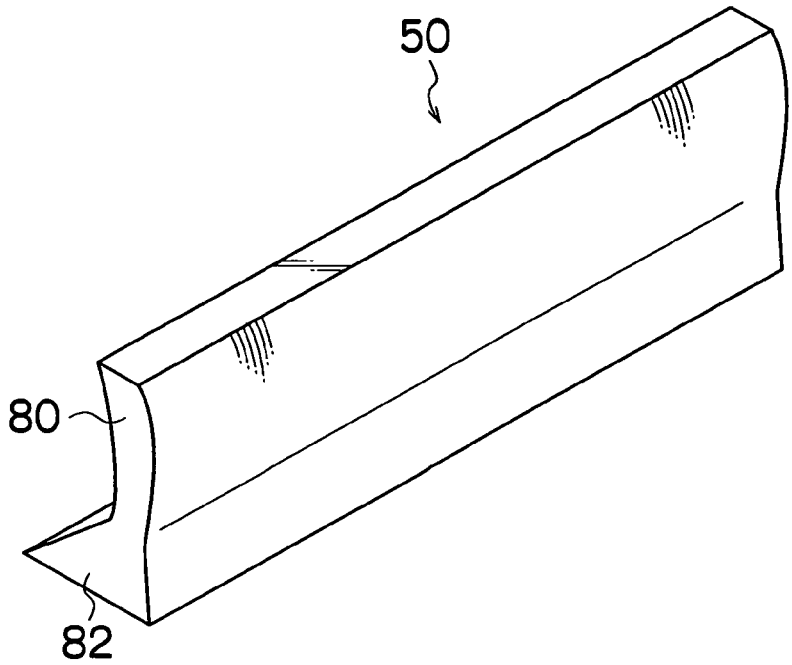
FIG. 19 is an oblique perspective diagram showing an embodiment of a movable member used in the sixth embodiment.
Figure 20:
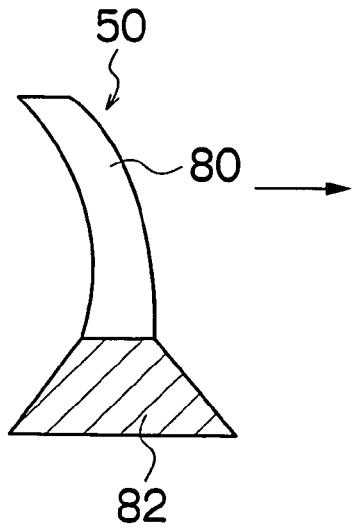
FIG. 20 is a side view of the movable member shown in FIG. 19.

FIG. 19 is an oblique perspective diagram showing an embodiment of the movable member used in the sixth embodiment; and FIG. 20 is a side view diagram of same. As shown in the second embodiment in FIG. 6, in a composition where the contact movement direction of the movable member 50 with respect to the flow channel wall 28A is taken to be a uniform direction (the same direction), and the air bubbles are collected in the uniform direction by switching the magnetic field generation devices 52 and 66 between when a contact movement (forward motion) is performed and when a non-contact movement (return motion) is performed, then desirably, the structure in which a portion of the elastic member 80 of the movable member 50 does not reverse, as show in FIG. 19 and FIG. 20, is adopted.

In the embodiment shown in these drawings, a portion of the elastic member 80 has a shape which is previously curved in a rearward direction with respect to the direction of travel (the wiping direction), and the base section 82 which holds the elastic member 80 has a structure with a substantially trapezoid cross-sectional shape which is broad in the bottom face section to stably hold the elastic member 80 so that the direction of the curve is not inversed.

Figure 21:
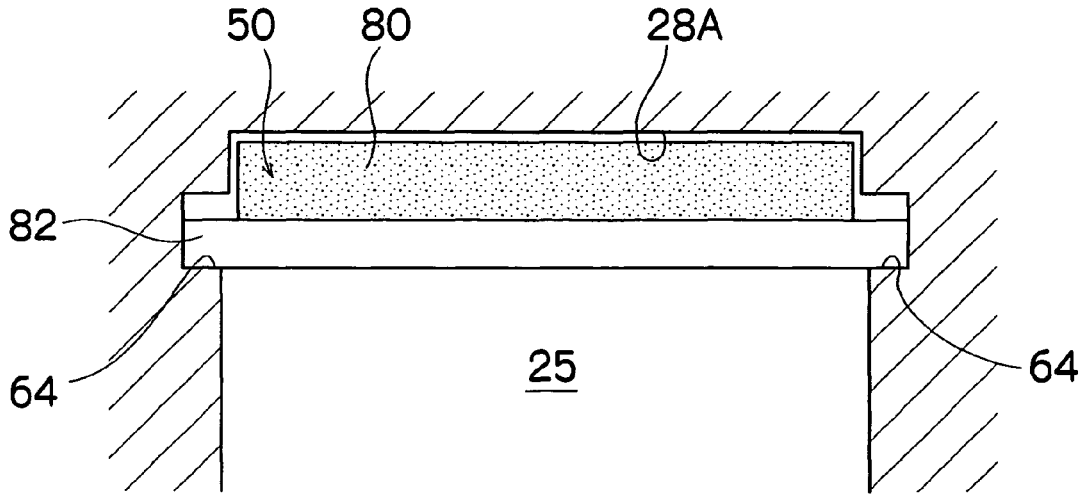
FIG. 21 is a principal schematic drawing of the liquid ejection head according to the sixth embodiment of the present invention.

Furthermore, this base section 82 is formed by a ferromagnetic body, and hence the base section 82 creates a section which reacts to the magnetic field. As shown in FIG. 21, similarly to the compositions described in FIG. 1 to FIG. 12, and the like, the movable member 50 supported on holding sections 64 is moved while being made to contact the flow channel wall 28A by means of a magnetic field generated by a magnetic field generating device (not shown in the drawings).

Seventh Embodiment

Figure 22:
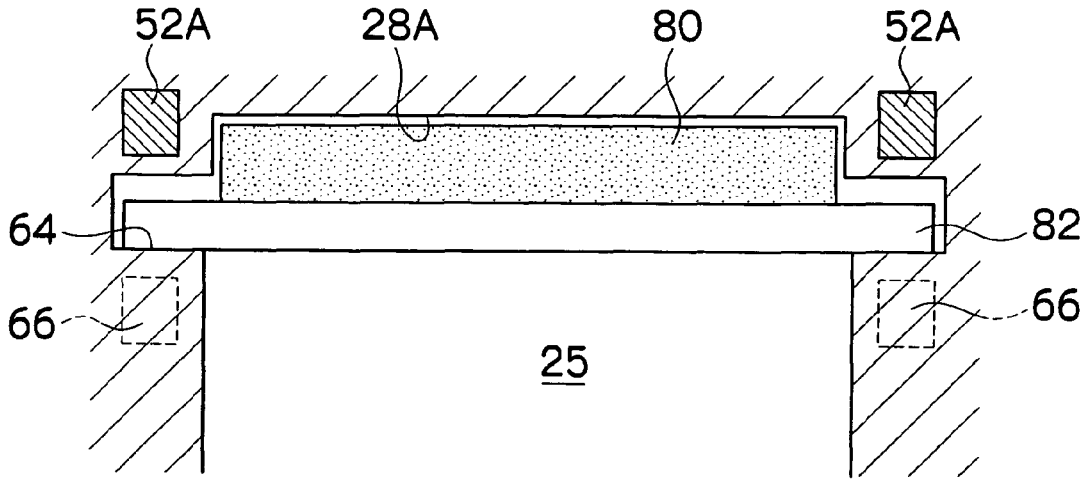
FIG. 22 is a principal schematic drawing of a liquid ejection head according to a seventh embodiment of the present invention.

FIG. 22 is a principal schematic drawing showing a seventh embodiment. In the embodiment shown in FIG. 22, magnetic force generation devices 52A, 52A, 66 and 66 are provided in the vicinity of the holding sections 64. In other words, as shown in FIG. 22, the magnetic field generation devices 52A, 52A are disposed respectively above the portions of the base section 82 which engage with the holding sections 64 (namely, the sections on either end where the elastic member 80 is not formed).

Figure 23:
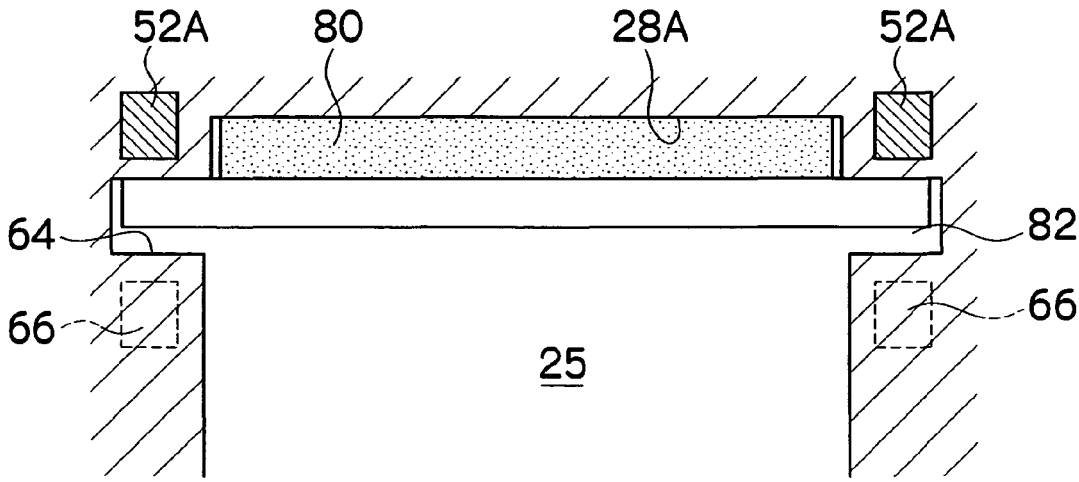
FIG. 23 is a diagram showing a state where a movable member is in contact with a flow channel wall in the seventh embodiment.

The movable member 50 is lifted up and pressed against the flow channel wall 28A by the magnetic field generated by these magnetic force generation devices 52A and 52A, thereby causing the elastic member 80 to make tight contact with the flow channel wall 28A, as shown in FIG. 23. By moving the magnetic force generation devices 52A in this state, in the direction perpendicular to the plane of the drawing, the flow channel wall 28A is wiped by the elastic member 80.

According to this composition, since the distance between each of the portions of the movable member 50 which are attracted by the magnetic field (namely the respective end sections of the base section 82), and each of the magnetic force generation devices 52A, is reduced, then it is possible to pull the movable member 50 strongly.

Furthermore, since the movable member 50 is moved while being fixed at either side of the member, the stability of the member is increased and skewed travel during movement of the member is not liable to occur.

Moreover, similarly to the embodiment shown in FIG. 7, in the embodiment show in FIGS. 22 and 23, it is also possible to separate the elastic member 80 from the flow channel wall 28A by means of a composition in which the magnetic force generation devices 66 and 66 are provided on the under side of the holding sections 64.

Eighth Embodiment

Figure 24:
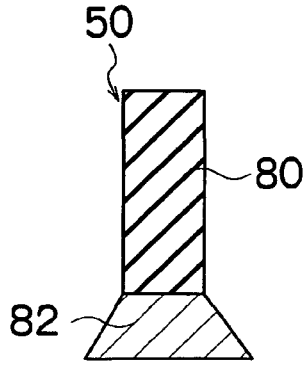
FIG. 24 is a side view diagram showing an embodiment of the composition of a movable member used in a liquid ejection head according to an eighth embodiment of the present invention.

The movable member 50 shown in FIGS. 19 and 20 has a structure in which the elastic member 80 is not reversed, on the basis of the assumption of the movement in one direction only; however, instead of this, it is also possible to adopt a mode which uses a movable member 50 having an elastic member 80 which rises up in a substantially vertical direction when viewed from the side, as shown in FIG. 24, in such a manner that it can perform reciprocating (bidirectional) movement (to-and-fro motion).

According to the elastic member 80 having approximate linear symmetry with respect to the central axis, the direction of deformation (direction of bending) of the elastic member 80 can be reversed in accordance with the direction of movement of the movable member 50.

Figure 25:
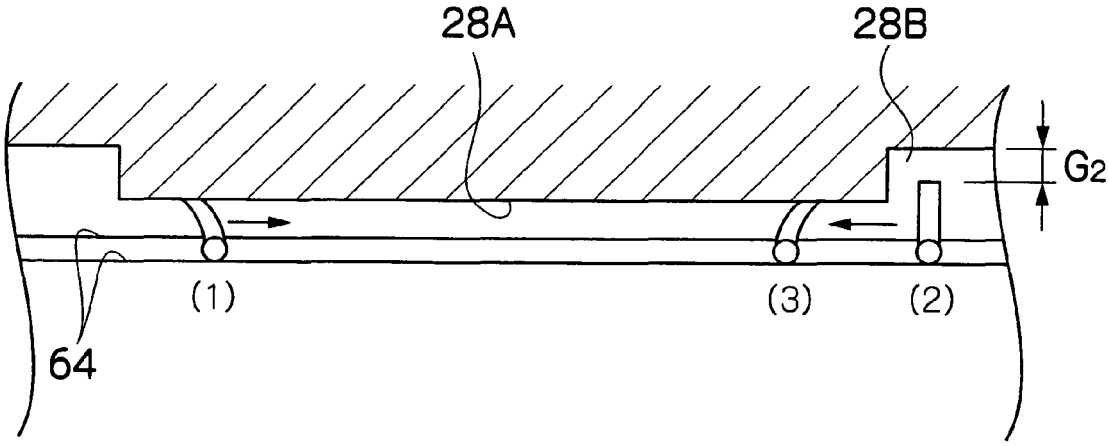
FIG. 25 is a side view diagram showing a schematic view of the movement of the movable member in the liquid ejection head according to the eighth embodiment.

As shown in FIG. 25, a recess section 28B which forms a projection-shaped space for reversing the direction of movement of the movable member 50 is formed in a portion of the flow channel wall 28A that the movable member 50 make contact with. The projection-shaped space formed by this recess section 28A functions as an "escape" space where the contact with the elastic member 80 is avoided. In summary, the projection-shaped space for releasing the distortion of the elastic member 80 is formed in a portion of the ceiling face of the common flow channel 25.

In the state represented by (1) in FIG. 25, the elastic member 80 of the movable member 50 moves in the rightward direction in FIG. 25 while making contact with the flow channel wall 28A. In this case, the elastic member 80 wipes the flow channel wall 28A in a state where it is distorted in a rearward direction with respect to the direction of travel. When the movable member 50 subsequently arrives at a position opposing the recess section 28B represented by (2) in FIG. 25, the elastic member 80 ceases to make contact with the wall surface and is released from the deformed state where the elastic member 80 keeps during the contact with the flow channel wall 28A. In other words, the elastic member 80 returns from a deformed state to its original shape, due to the inherent restoring force of the material of the elastic member 80, thereby assuming a substantially vertically erect state. In this state, a gap G2 is formed between the elastic member 80 and the wall face, as shown in FIG. 25. Accordingly, the direction of movement of the movable member 50 can be reversed readily, without applying excessive force to the elastic member 80.

Thereupon, as in the state represented by (3) in FIG. 25, the direction of travel of the movable member 50 is reversed and the flow channel wall 28A is wiped by the movable member 50 in the reverse direction (leftward direction). In this case, the elastic member 80 bends in the rearward direction with respect to the direction of travel (in other words, it bends in the opposite direction to that in the case in (1)), and thereby makes contact with the flow channel wall 28A.

The lines marked by reference numeral 64 in FIG. 25 indicate a holding section which restricts the position of the movable member 50, and this holding section 64 also serves as a guide section forming a travel path for the movement of the movable member 50. For the device which moves the movable member 50, it is possible to adopt compositions similar to the embodiments shown in FIGS. 2 and 22, or the like.

Furthermore, in the embodiment in FIG. 25, the air bubbles collected by the elastic member 80 are released when the deformed state of the elastic member 80 is released (when the elastic member 80 extends fully (extends completely)), and therefore, desirably, the air bubble removal flow channel (not shown in the drawings) is formed at this position where the elastic member 80 extends fully (in the projection-shaped space formed by the recess section 28B).

Figure 26:
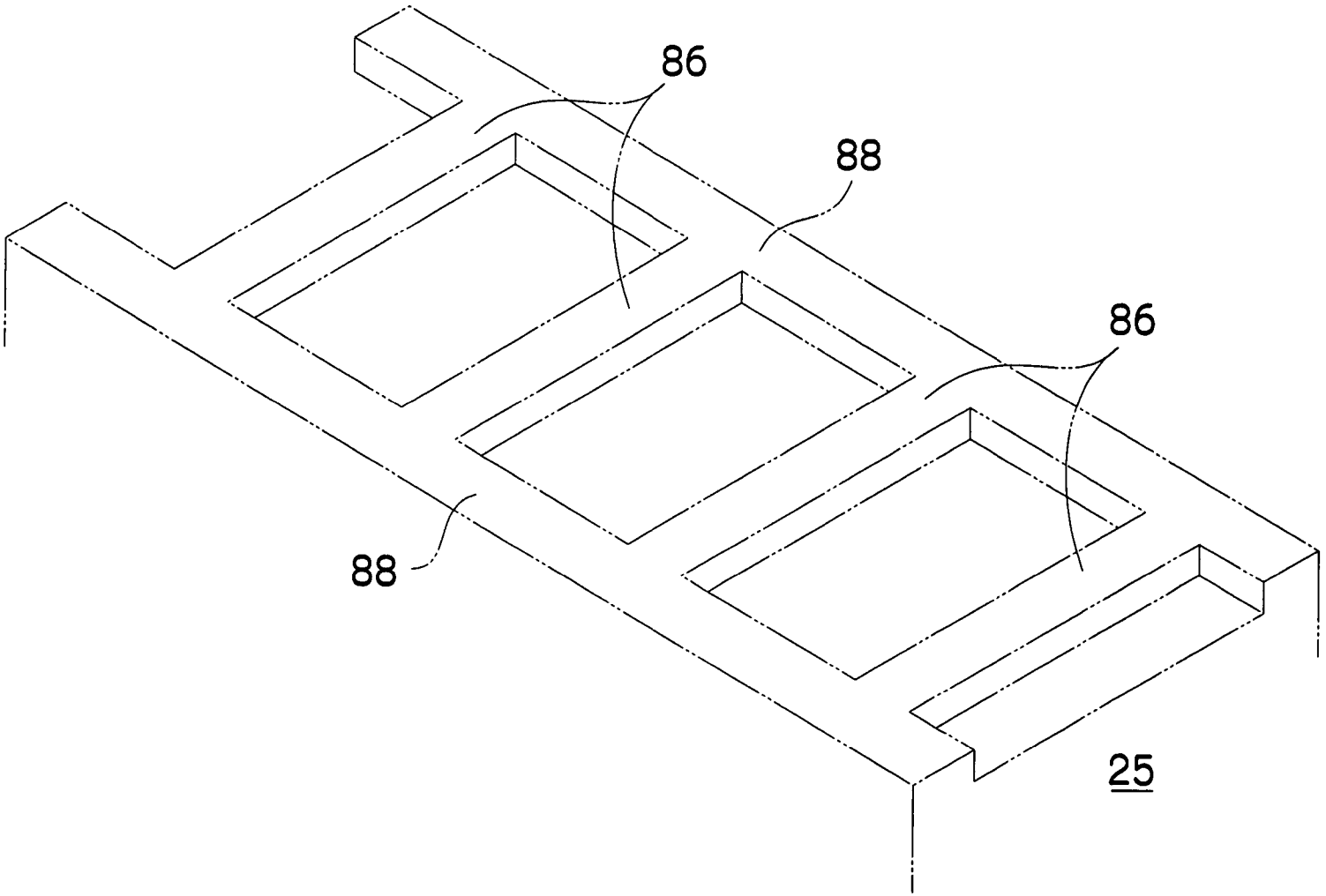
FIG. 26 is an oblique perspective diagram showing an embodiment of the composition of a flow channel wall.

The projection-shaped space described above (hereinafter, also called "reversal space") may be provided in one position or in a plurality of positions in the common flow channel 25. For example, as shown in FIG. 26, a plurality of reversal spaces 86, 86, . . . are formed in the ceiling face of the common flow channel 25 and these reversal spaces 86, 86, . . . are connected to escape grooves 88 and 88 for air bubble removal. The air bubbles released into the reversal spaces 86, 86, . . . are expelled to the exterior by means of the escape grooves 88 and 88 for air bubble removal.

A mode is also possible in which a pump 74 is used as a device for removing air bubbles collected in the escape holes 88 and 88 for air bubble removal, as shown in FIG. 17.

Ninth Embodiment

Figure 27:
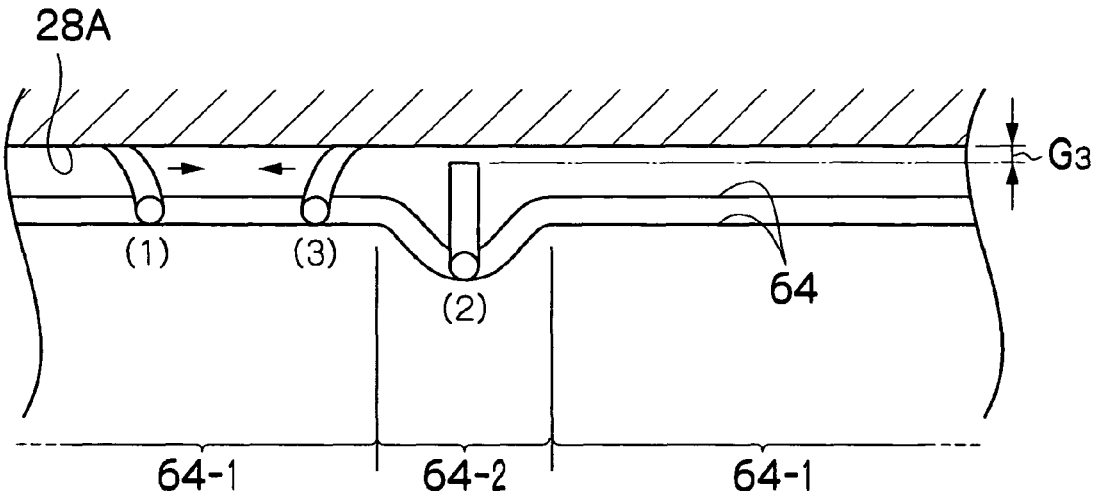
FIG. 27 is a side view diagram showing a schematic view of the movement of a movable member in a liquid ejection head according to a ninth embodiment of the present invention.

The embodiment shown in FIG. 27 is also possible as another device for reversing the direction of movement of the movable member. In the composition in FIG. 27, the guide section/holding section 64 for the movable member 50 form a travel path including a portion which lowers the position of the movable member 50 with respect to the flow channel wall 28A. In other words, the flow channel wall 28A is a flat surface (flat plane); and the path of travel of the movable member 50 formed by the guide section/holding section 64 comprises a linear region (first travel path section 64-1) in which the elastic member 80 moves while pressing against the flow channel wall 28A, and a smoothly curved region (second travel path section 64-2) in which the movable member 50 moves downward in the diagram in such a manner that the deformed state of the elastic member 80 is released by separating the elastic member 80 from the flow channel wall 28A. As shown in FIG. 27, each first path travel section 64-1 and the second path travel section 64-2 are connected continuously in such a manner that a smooth movement of the movable member 50 can be achieved.

In a state represented by (1) in FIG. 27, the elastic member 80 of the movable member 50 moves in the rightward direction while making contact with the flow channel wall 28A. In this case, the elastic member 80 wipes the flow channel wall 28A in a state where it is distorted in a rearward direction with respect to the direction of travel. When the movable member 50 arrives at the position indicated by (2) in FIG. 27, the elastic member 80 ceases to make contact with the wall surface and is released from the deformed state it assumes during the contact with the flow channel wall 28A. In other words, the elastic member 80 returns from a deformed state to its original shape, due to the inherent restoring force of the material of the elastic member 80, thereby assuming a substantially vertically erect state. In this state, a gap G3 is formed between the elastic member 80 and the wall face. Therefore, excessive force is not applied to the elastic member 80 and the direction of movement of the movable member 50 can be reversed more readily.

Thereupon, as shown in (3) in FIG. 27, the direction of travel of the movable member 50 is reversed and the movable member 50 wipes the flow channel wall 28A in the reverse direction (leftward direction). In this case, the elastic member 80 bends in the rearward direction with respect to the direction of travel (in other words, it bends in the opposite direction to that in the case in (1)), and thereby makes contact with the flow channel wall 28A. Since the air bubbles are released when the elastic member 80 extends (at position (2)), then desirably, the flow channel for removing air bubbles (not shown in FIG. 27) is formed in the vicinity of the position (position (2)) where the elastic member 80 extends fully.

The composition shown in FIG. 27 has benefits in that since the ceiling of the flow channel is flatter than in the eighth embodiment described in FIG. 25, positions where the air bubbles are liable to stagnate are not formed.

Tenth Embodiment

Figure 28:
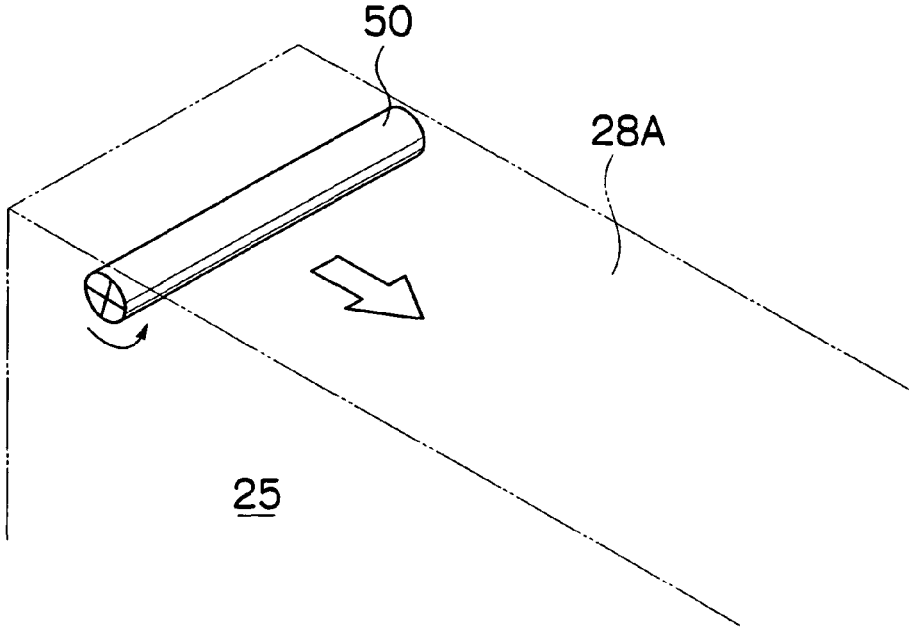
FIG. 28 is an oblique perspective diagram showing a principal composition of a liquid ejection head according to a tenth embodiment of the present invention.

FIG. 28 is a schematic drawing of the principal part of a tenth embodiment. As shown in FIG. 28, the movable member 50 has a circular bar shape and is composed in such a manner that it is moved while rolling over the wall surface of the flow channel wall 28A. In this case, the movable member 50 is composed to have relatively lower hydrophilic properties than the flow channel wall 28A.

Figure 29:
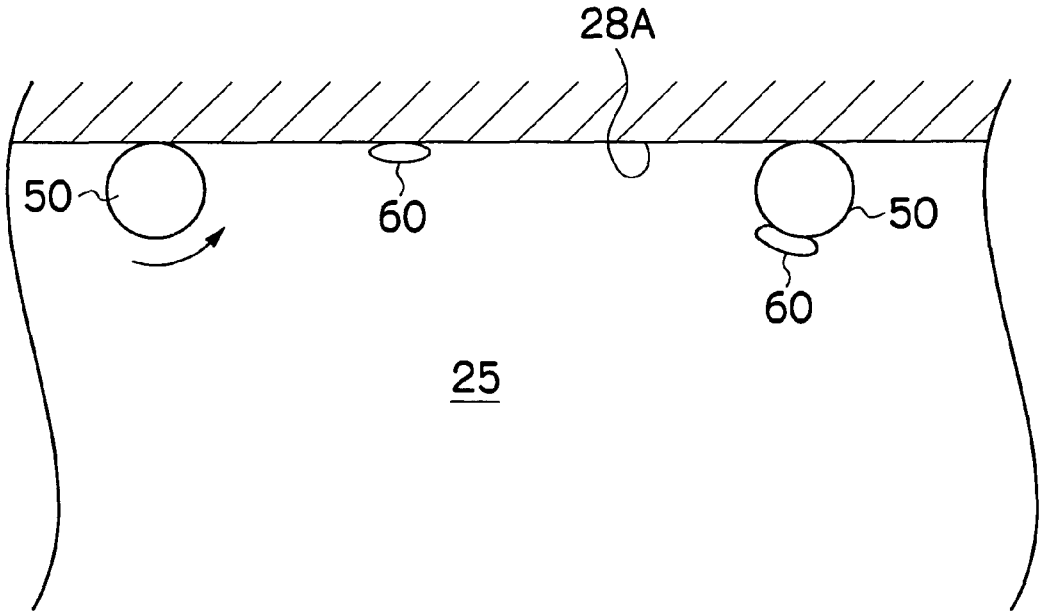
FIG. 29 is a side view diagram showing a schematic view of the movement of a movable member according to the tenth embodiment.

According to the composition described above, as shown in FIG. 29, it is possible to collect the air bubbles 60 adhering the flow channel wall 28A by making them attach to the movable member 50. A desirable composition is one in which a system capable of stripping the attached air bubbles from the movable member 50 is provided at the end towards which the movable member 50 rolls.

Furthermore, according to the present embodiment, since a round bar-shaped movable member 50 rolls over the wall face, benefits are obtained in that less damage is caused to the wall face in comparison with a composition based on a sliding system as described in FIG. 1 or the like.

Figure 30:
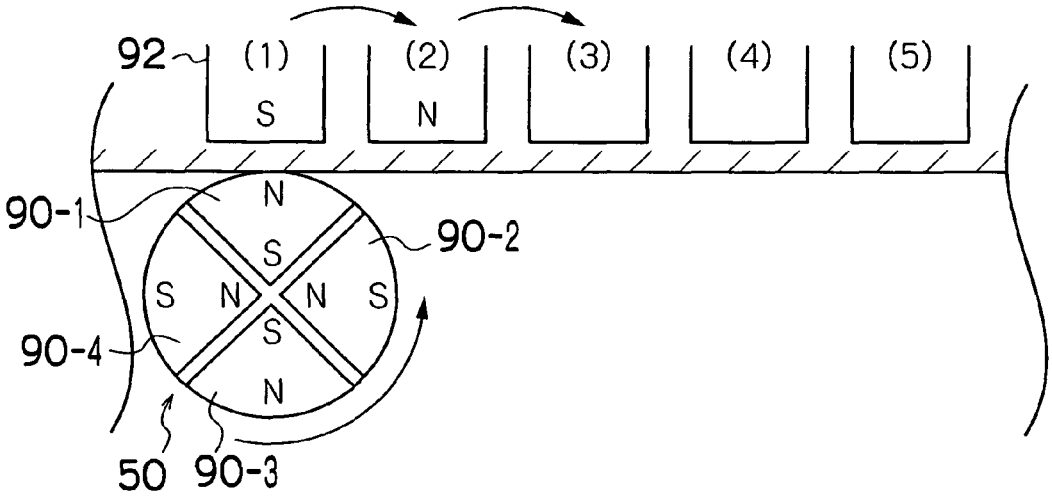
FIG. 30 is a schematic drawing showing one embodiment of a device which rolls the movable member in the tenth embodiment.

FIG. 30 is a schematic drawing showing one embodiment of a device which causes the movable member 50 to roll. This movable member 50 is constituted by four magnets 90-1 to 90-4 which are divided following the circumferential direction (here, the magnets are permanent magnets). Furthermore, a plurality of electromagnets 92 are arranged linearly following the direction of travel of the movable member 50, in the flow channel wall member side.

Figure 31:
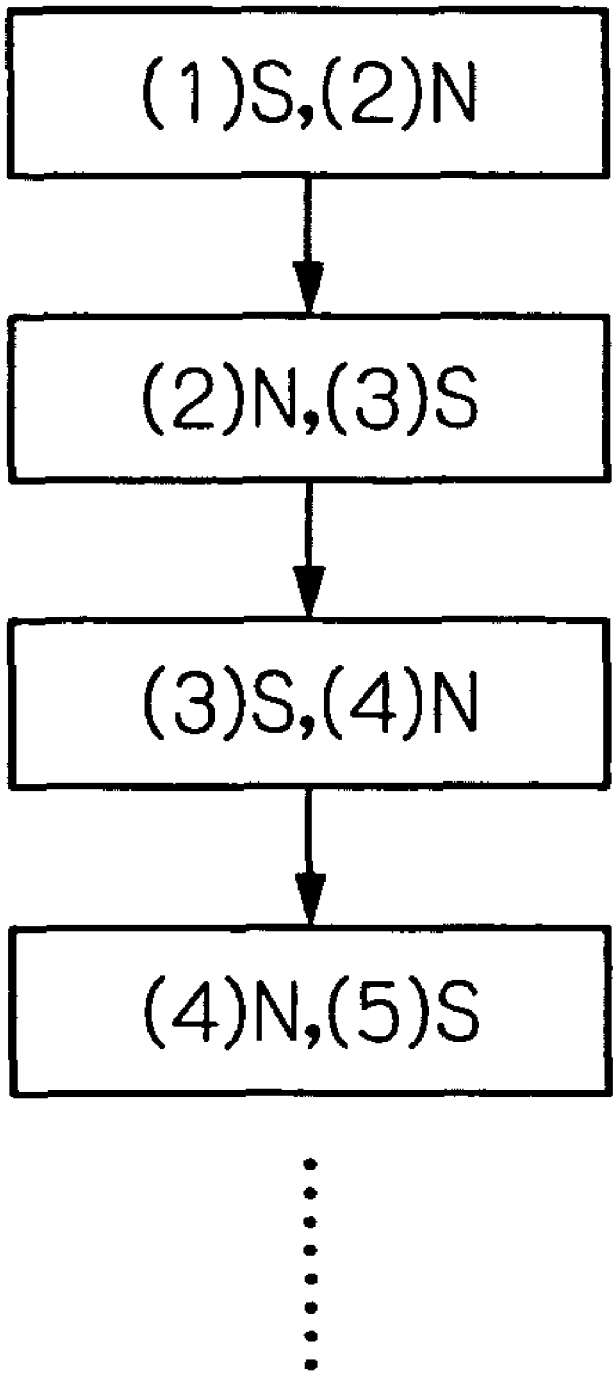
FIG. 31 is a flowchart showing an embodiment of the control of electromagnets shown in FIG. 30.

By successively controlling the polarity of the electromagnets 92 indicated by (1) to (5) in FIG. 30, it is possible to make the movable member 50 move while rotating. For example, by successively switching the polarity of the electromagnets 92 represented by (1) to (5) in the sequence shown in FIG. 31, it is possible to made the movable member 50 in FIG. 30 advance in the rightward direction in FIG. 30 while rolling over the surface of the flow channel wall 28A.

Eleventh Embodiment

In the embodiments shown in FIG. 1 to FIG. 27, the movable member which moves while making contact with the flow channel wall is constituted by a ferromagnetic body partially or wholly, but a composition may also be adopted in which all or a portion of the movable member is made of a permanent magnet.

Figure 32A:
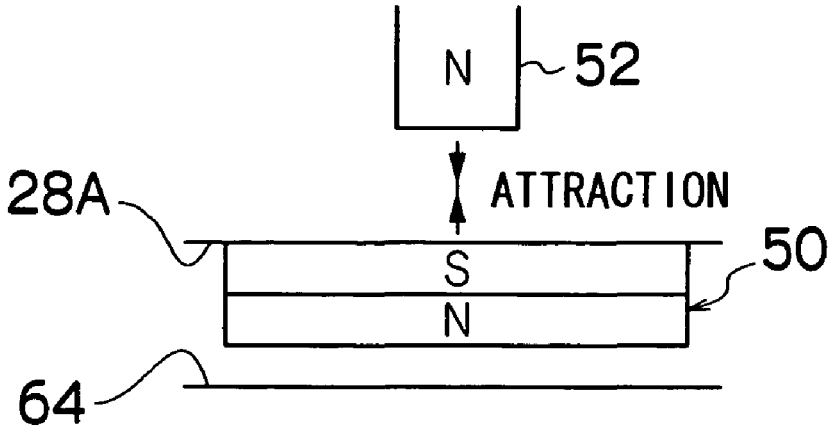
FIGS. 32A and 32B are principal schematic drawings of a liquid ejection head according to an eleventh embodiment of the present invention.
Figure 32B:
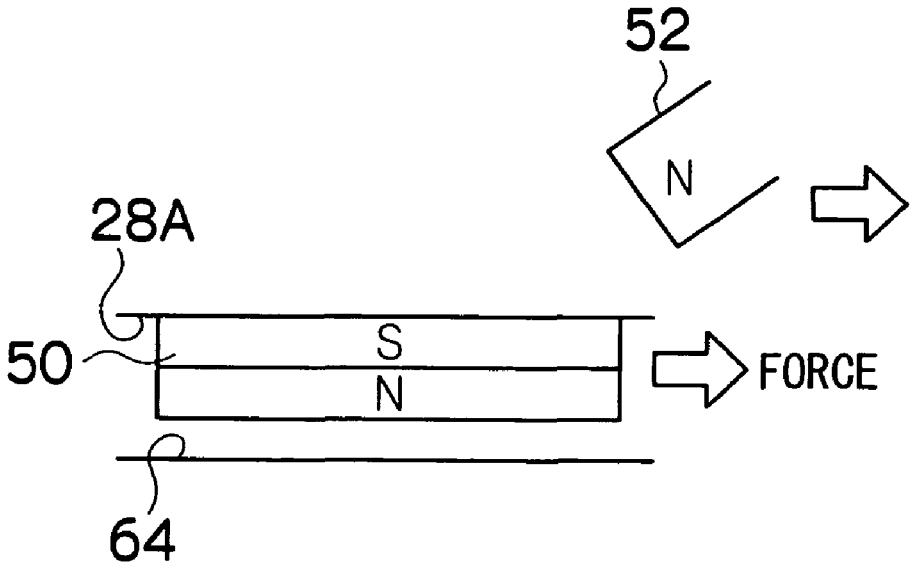

FIGS. 32A and 32B are diagrams showing a schematic view of an embodiment of a composition where a permanent magnet is inserted inside the movable member 50. The movable member 50 containing a permanent magnet has fixed polarity, and in FIGS. 32A and 32B, for example, the upper side is the S pole and the lower side is the N pole, and the structure is achieved in which the vertical reversion of the polarity is prevented (in other words, the movable member 50 has a shape which prevents the vertical reversion, or a holding section which holds the movable member is provided in such a manner that the vertical reversion of the polarity is prevented, or a combination of these is adopted).

Figure 33A:
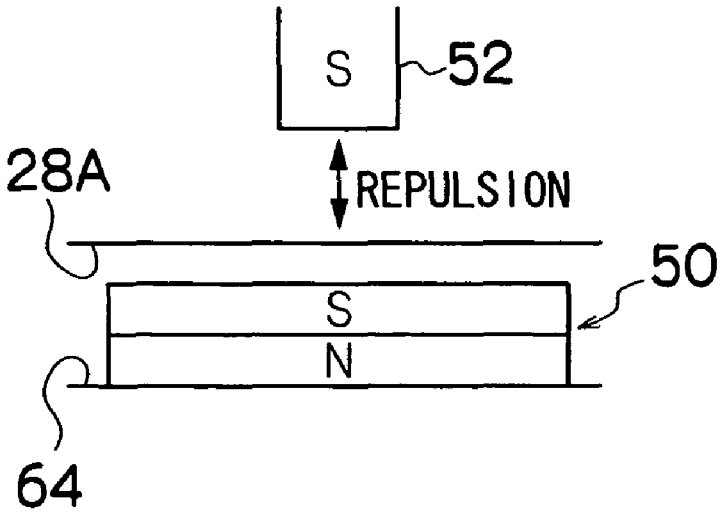
FIGS. 33A and 33B are diagrams showing an embodiment in which the orientation of the external magnetic field is switched in the eleventh embodiment.
Figure 33B:
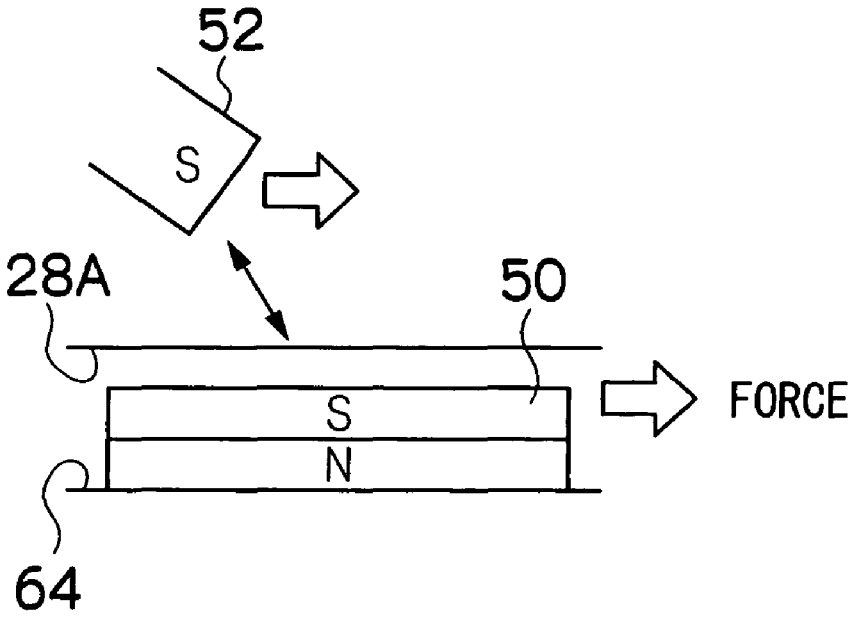

By changing the direction of the magnetic field generated by a magnetic field generation device 52 situated externally (external magnetic field), it is possible to select between a state where the movable member 50 is in contact with the flow channel wall 28A as shown in FIGS. 32A and 32B, and a state where the movable member 50 is separated from the flow channel wall 28A (non-contact state) as shown in FIGS. 33A and 33B.

In other words, as shown in FIG. 32A, it is possible to make the movable member 50 contact the flow channel wall 28A by means of the attracting force of the N pole of the magnetic force generation device 52. In this state, as shown in FIG. 32B, it is possible to pull and move the movable member 50 by moving the magnetic force generation device 52.

Furthermore, as shown in FIG. 33A, if an S pole magnetic field is applied by the magnetic force generation device 52, then the movable member 50 is separated from the flow channel wall 28A by the repulsing force of the S pole, and it is held by a holding section 64.

In a state where the movable member 50 is held by the holding section 64, as shown in FIG. 33B, it is possible to move the movable member 50 by means of the repulsing force, by pushing the movable member 50 from an oblique direction by means of the external magnetic field.

In other words, even if the movable member 50 is not in contact with the flow channel wall 28A, it can still be moved. According to this composition, benefits are obtained in that the movable member 50 can be controlled only from one side (here, the upper side) of the flow channel wall 28A.

Twelfth Embodiment

In addition to the compositions explained in the first to eleventh embodiments described above, it is also desirable to circulate the ink in the common flow channel 25, in accordance with the direction of travel of the movable member 50. By making the direction of circulation of the ink (flow direction) coincide with the direction of travel of the movable member 50 (the direction in which the movable member 50 moves while making contact with the flow channel wall 28A), it is easier to remove the air bubbles in the direction of ink circulation.

Moreover, a more desirable composition is one in which the flow channel wall is inclined upwards in the direction in which it is sought to move the air bubbles (see FIG. 5).

Embodiment of Application to Inkjet Recording Apparatus

Next, an embodiment of an image forming apparatus using a liquid ejection head having the structure described in the first to twelfth embodiments is described below.

Figure 34:
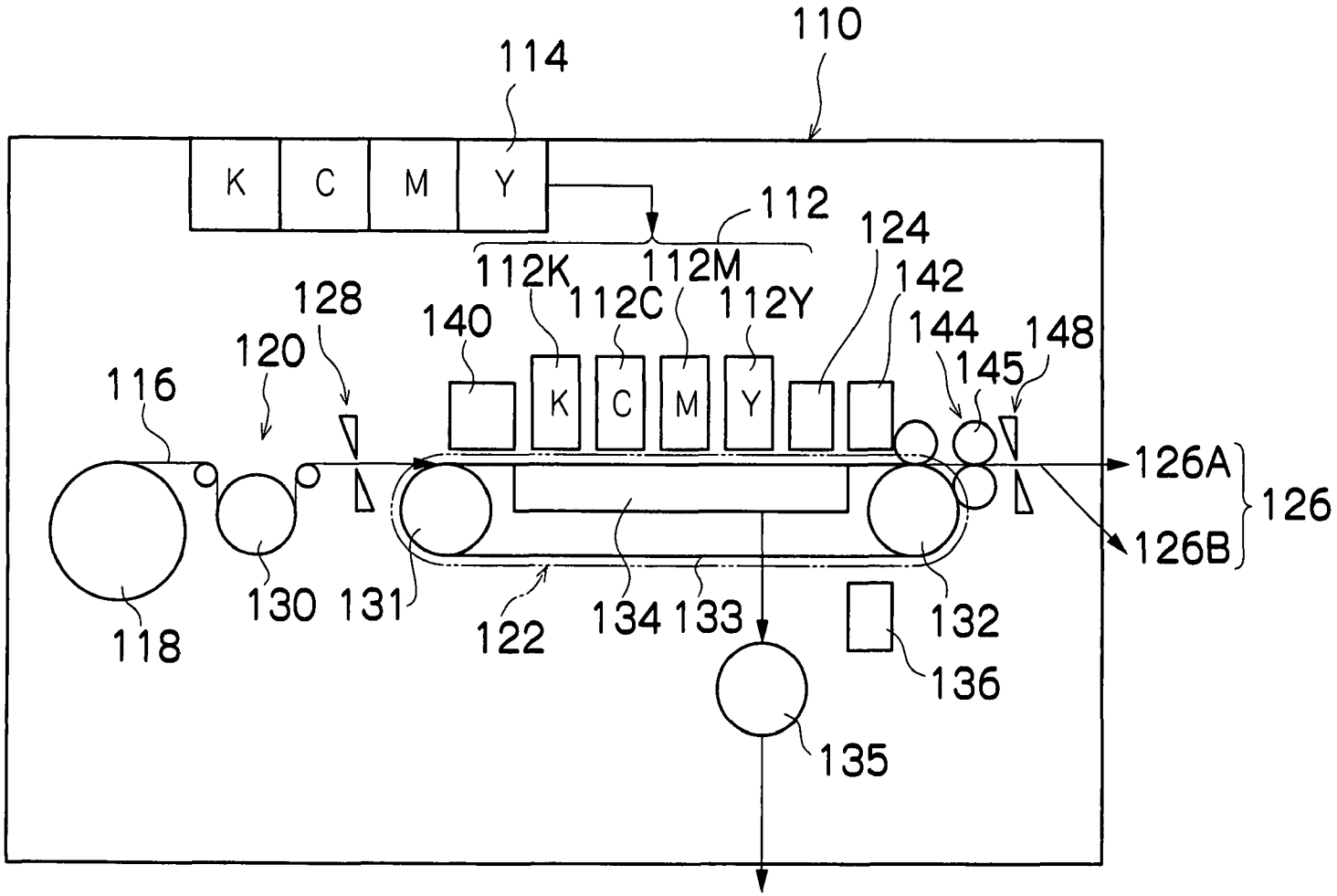
FIG. 34 is a general schematic drawing of an inkjet recording apparatus which forms one embodiment of an image forming apparatus relating to the present invention.

FIG. 34 is a general schematic drawing of an inkjet recording apparatus which forms one embodiment of an image forming apparatus relating to the present invention. As shown in FIG. 16, the inkjet recording apparatus 110 comprises: a print unit 112 including a plurality of inkjet heads (hereinafter, called "heads") 112K, 112C, 112M and 112Y provided for ink colors of black (K), cyan (C), magenta (M), and yellow (Y), respectively; an ink storing and loading unit 114 for storing inks to be supplied to the heads 112K, 112C, 112M and 112Y; a paper supply unit 118 for supplying recording paper 116 forming a recording medium; a decurling unit 120 for removing curl in the recording paper 116; a belt conveyance unit 122, disposed facing the nozzle face (ink ejection face) of the print unit 112, for conveying the recording paper 116 while keeping the recording paper 116 flat; a print determination unit 124 for reading the printed result produced by the print unit 112; and a paper output unit 126 for outputting recorded recording paper (printed matter) to the exterior.

The liquid ejection head 10 according to any one of the first to twelfth embodiments described above is used as each of the heads 112K, 112C, 112M and 112Y of the print unit 112.

The ink storing and loading unit 114 shown in FIG. 34 has ink tanks for storing the inks of K, C, M and Y to be supplied to the heads 112K, 112C, 112M and 112Y, and the tanks are connected to the heads 112K, 112C, 112M and 112Y by means of prescribed channels. The ink storing and loading unit 114 has a warning device (for example, a display device or an alarm sound generator) for warning when the remaining amount of any ink is low, and has a mechanism for preventing loading errors among the colors.

In FIG. 34, a magazine for rolled paper (continuous paper) is shown as an embodiment of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording medium (media) can be used, it is preferable that an information recording medium such as a bar code and a wireless tag containing information about the type of media is attached to the magazine, and by reading the information contained in the information recording medium with a predetermined reading device, the type of recording medium to be used (type of media) is automatically determined, and ink-droplet ejection is controlled so that the ink-droplets are ejected in an appropriate manner in accordance with the type of medium.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (first cutter) 128 is provided as shown in FIG. 34, and the continuous paper is cut into a desired size by the cutter 128. When cut papers are used, the cutter 128 is not required.

The decurled and cut recording paper 116 is delivered to the suction belt conveyance unit 122. The suction belt conveyance unit 122 has a configuration in which an endless belt 133 is set around rollers 131 and 132 so that the portion of the endless belt 133 facing at least the nozzle face of the printing unit 112 and the sensor face of the print determination unit 124 forms a horizontal plane (flat plane).

The belt 133 has a width that is greater than the width of the recording paper 116, and a plurality of suction apertures (not shown) are formed on the belt surface. A suction chamber 134 is disposed in a position facing the sensor surface of the print determination unit 124 and the nozzle surface of the printing unit 112 on the interior side of the belt 133, which is set around the rollers 131 and 132, as shown in FIG. 34. The suction chamber 134 provides suction with a fan 135 to generate a negative pressure, and the recording paper 116 is held on the belt 133 by suction. It is also possible to use an electrostatic attraction method, instead of a suction-based attraction method.

The belt 133 is driven in the clockwise direction in FIG. 34 by the motive force of a motor (not shown in the drawings) being transmitted to at least one of the rollers 131 and 132, which the belt 133 is set around, and the recording paper 116 held on the belt 133 is conveyed from left to right in FIG. 34.

Since ink adheres to the belt 133 when a marginless print job or the like is performed, a belt-cleaning unit 136 is disposed in a predetermined position (a suitable position outside the printing area) on the exterior side of the belt 133. Although the details of the configuration of the belt-cleaning unit 136 are not shown, embodiments thereof include a configuration of nipping cleaning rollers such as a brush roller and a water absorbent roller, an air blow configuration in which clean air is blown onto the belt 133, or a combination of these. In the case of the configuration of nipping the cleaning rollers, it is preferable to make the line velocity of the cleaning rollers different than that of the belt 133 to improve the cleaning effect.

The inkjet recording apparatus 110 can comprise a roller nip conveyance mechanism, instead of the suction belt conveyance unit 122. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 140 is disposed on the upstream side of the printing unit 112 in the conveyance pathway formed by the suction belt conveyance unit 122. The heating fan 140 blows heated air onto the recording paper 116 to heat the recording paper 116 immediately before printing so that the ink deposited on the recording paper 116 dries more easily.

The heads 112K, 112C, 112M and 112Y of the printing unit 112 are full line heads having a length corresponding to the maximum width of the recording paper 116 used with the inkjet recording apparatus 110, and comprising a plurality of nozzles for ejecting ink arranged on a nozzle face through a length exceeding at least one edge of the maximum-size recording medium (namely, the full width of the printable range).

The print heads 112K, 112C, 112M and 112Y are arranged in color order (black (K), cyan (C), magenta (M) and yellow (Y)) from the upstream side in the feed direction of the recording paper 116, and these respective heads 112K, 112C, 112M and 112Y are fixed extending in a direction substantially perpendicular to the conveyance direction of the recording paper 116.

A color image can be formed on the recording paper 116 by ejecting inks of different colors from the heads 112K, 112C, 112M and 112Y, respectively, onto the recording paper 116 while the recording paper 116 is conveyed by the suction belt conveyance unit 122.

By adopting a configuration in which the full line heads 112K, 112C, 112M and 112Y having nozzle rows covering the full paper width are provided for the respective colors in this way, it is possible to record an image on the full surface of the recording paper 116 by performing just one operation (one sub-scanning operation) of relatively moving the recording paper 116 and the printing unit 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY standard colors (four colors) is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 124 illustrated in FIG. 34 has an image sensor (line sensor or area sensor) for capturing an image of the droplet ejection result of the print unit 112, and functions as a device to check for ejection defects such as blockages, landing position displacement, and the like, of the nozzles, on the basis of the image of ejected droplets read in by the image sensor. A test pattern or the target image printed by the print heads 112K, 112C, 112M, and 112Y of the respective colors is read in by the print determination unit 124, and the ejection performed by each head is determined. Ejection determination is made by, for example, finding presence or absence of ejection, measuring dot sizes, and dot landing positions.

A post-drying unit 142 is disposed following the print determination unit 124. The post-drying unit 142 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not shown in FIG. 34, the paper output unit 126A for the target prints is provided with a sorter for collecting prints according to print orders.

Modification Example

In the present embodiment, an inkjet recording apparatus having a full line type head is described, but the scope of application of the present invention is not limited to this. For example, the present invention may also be applied to a case where images are formed by using a head of a length which is shorter than the width dimension of the recording medium (the recording paper 116 or other print media), and scanning the head a plurality of times, as in a shuttle scanning method.

Moreover, in the foregoing explanation, an inkjet recording apparatus is described, but the scope of application of the present invention is not limited to this. For example, the liquid ejection apparatus according to the present invention may also be applied to a photographic image forming apparatus having a liquid ejection head which applies developing solution, or the like, onto a printing paper by means of a non-contact method. Furthermore, the scope of application of the present invention is not limited to an image forming apparatus, and the present invention may also be applied to various other types of apparatuses which spray various types of liquids, toward an ejection receiving medium, by means of a liquid ejection head (such as a coating device, an application device, wiring pattern printing device, or the like).

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus comprising:

a plurality of ejection ports which eject liquid;

a plurality of pressure chambers which are connected respectively to the ejection ports;

pressure generating elements which are provided to correspond respectively to the pressure chambers and create a pressure change in the liquid in the respective pressure chambers;

a common flow channel which is connected to the pressure chambers and supplies the liquid to the pressure chambers;

a movable member which is disposed inside the common flow channel and can move while making contact with a flow channel wall forming one portion of an internal circumferential surface of the common flow channel; and a movement device which moves the movable member inside the common flow channel.

2. The liquid ejection apparatus as defined in claim 1, wherein at least a portion of the movable member is constituted by a ferromagnetic body; and the movement device includes a magnetic field generation device which generates a magnetic field.

3. The liquid ejection apparatus as defined in claim 1, wherein the movable member includes: an inclined plane section which has an acute angle so as to enter in between the flow channel wall and an air bubble adhering to the flow channel wall and strip the air bubble from the flow channel wall; and a hollow section which retains the air bubble stripped from the flow channel wall.

4. The liquid ejection apparatus as defined in claim 1, wherein the flow channel wall along which the movable member slides has an inclined plane structure wherein height of the flow channel wall gradually increases in a direction of movement of the movable member.

5. The liquid ejection apparatus as defined in claim 1, further comprising a holding section which is provided in the common flow channel and supports a lower face of the movable member.

6. The liquid ejection apparatus as defined in claim 5, wherein the holding section supports the lower face of the movable member in such a manner that the movable member is separated from the flow channel wall.

7. The liquid ejection apparatus as defined in claim 1, wherein the flow channel wall forms a ceiling face of the common flow channel;

the flow channel wall has a non-linear shape in which height of the flow channel wall varies when viewed in a direction of movement of the movable member; and the movable member has a non-linear shape when viewed in the direction of movement of the movable member, in such a manner that the non-linear shape of the movable member matches the non-linear shape of the flow channel wall.

8. The liquid ejection apparatus as defined in claim 1, further comprising a flow channel which is provided in an end section of the common flow channel in terms of a direction of movement of the movable member and via which an air bubble is expelled to an exterior of the common flow channel.

9. The liquid ejection apparatus as defined in claim 1, wherein the movable member has a recess shape which is hollowed in a reverse direction with respect to a direction of movement of the movable member by the movement device.

10. The liquid ejection apparatus as defined in claim 1, wherein the movable member includes: a projecting end section which projects in a direction of movement of the movable member by the movement device; and an end portion which is located posteriorly to the projecting end section in terms of the direction of movement of the movable member by the movement device; and an air bubble removal groove into which an air bubble stripped from the flow channel wall by the movable member is introduced, is provided in an end part of the common liquid chamber which overlaps with the end portion of the movable member.

11. The liquid ejection apparatus as defined in claim 1, wherein a portion of the movable member which makes contact with the flow channel wall is constituted by an elastic member.

12. The liquid ejection apparatus as defined in claim 11, wherein the flow channel wall includes a recess section which forms a projection-shaped space in which a gap is formed between the flow channel wall and the elastic member that is released from a deformed state assumed while the movable member is in contact with the flow channel wall and returns to an original shape of the elastic member.

13. The liquid ejection apparatus as defined in claim 11, further comprising a guide section which is provided in the common flow channel and restricts a position of the movable member during movement of the movable member, wherein the guide section has a shape which forms a travel path for guiding the movable member to a position where a gap is formed between the flow channel wall and the elastic member that is released from a deformed state assumed while the movable member is in contact with the flow channel wall and returns to an original shape of the elastic member.

14. The liquid ejection apparatus as defined in claim 1, wherein the movable member has a columnar shape and relatively lower lyophilic properties than the flow channel wall, and is moved while rolling over the flow channel wall by the movement device.

15. The liquid ejection apparatus as defined in claim 1, wherein the movable member includes a permanent magnet.

16. The liquid ejection apparatus as defined in claim 1, further comprising a diaphragm which forms a portion of surfaces of the pressure chambers, wherein the pressure generating elements are formed by piezoelectric elements which are provided on an opposite surface of the diaphragm from the pressure chambers; and the common flow channel is provided on an opposite side of the diaphragm from the pressure chambers.

17. An image forming apparatus comprising the liquid ejection apparatus as defined in claim 1, the image forming apparatus forming an image on a recording medium by means of the liquid ejected from the ejection ports.

* * * * *